US011387094B2

(12) United States Patent
Stewart et al.

(10) Patent No.: US 11,387,094 B2
(45) Date of Patent: Jul. 12, 2022

(54) TIME OF FLIGHT MASS SPECTROMETER AND METHOD OF MASS SPECTROMETRY

(71) Applicant: Thermo Fisher Scientific (Bremen) GmbH, Bremen (DE)

(72) Inventors: Hamish Stewart, Bremen (DE); Dmitry E. Grinfeld, Bremen (DE); Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 17/189,780

(22) Filed: Mar. 2, 2021

(65) Prior Publication Data

US 2021/0272790 A1 Sep. 2, 2021

(30) Foreign Application Priority Data

Mar. 2, 2020 (GB) ..... 2002968

(51) Int. Cl.
*H01J 49/40* (2006.01)
*H01J 49/02* (2006.01)
*H01J 49/44* (2006.01)

(52) U.S. Cl.
CPC ..... *H01J 49/406* (2013.01); *H01J 49/022* (2013.01); *H01J 49/025* (2013.01); *H01J 49/401* (2013.01); *H01J 49/403* (2013.01); *H01J 49/446* (2013.01)

(58) Field of Classification Search
CPC ..... H01J 49/406; H01J 49/022; H01J 49/025; H01J 49/401; H01J 49/06; H01J 49/40; H01J 49/063; H01J 49/403; H01J 49/446
(Continued)

(56) References Cited

U.S. PATENT DOCUMENTS 8,212,209 B2 7/2012 Bowdler
9,136,100 B2 9/2015 Giles
(Continued)

FOREIGN PATENT DOCUMENTS

EP 2584587 A2 4/2013
GB 2403063 A 12/2004
(Continued)

OTHER PUBLICATIONS

Madsen et al., "Top-Down Protein Fragmentation by Infrared Multiphoton Dissociation in a Dual Pressure Linear Ion Trap," Analytical Chemistry, vol. 81., No. 21, Nov. 1, 2009, pp. 8677-8686.

(Continued)

*Primary Examiner* — Kiet T Nguyen

(57) ABSTRACT

A time-of-flight (ToF) mass spectrometer, comprising: a pulsed ion injector for forming an ion beam that travels along an ion path; a detector for detecting ions in the ion beam that arrive at the detector at times according to their m/z values; an ion focusing arrangement located between the ion injector and the detector for focusing the ion beam in at least one direction orthogonal to the ion path; and a variable voltage supply for supplying the ion focusing arrangement with at least one variable voltage that is dependent on a charge state and/or an amount of ions of at least one species of ions in the ion beam. A corresponding method of mass spectrometry is provided. The charge state and/or an amount of ions may be acquired from a pre-scan, or predicted. Tuning of the spectrometer based on a charge state and/or an amount of ions of at least one species of ions in the ion beam may be performed on the fly.

25 Claims, 10 Drawing Sheets

(58) Field of Classification Search
USPC ..... 250/287
See application file for complete search history.

(56) References Cited

U.S. PATENT DOCUMENTS

| | | | | |
|---|---|---|---|---|
| 9,136,101 | B2 | 9/2015 | Grinfeld et al. | |
| 9,373,490 | B1 * | 6/2016 | Nishiguchi | H01J 49/403 |
| 9,773,657 | B2 | 9/2017 | Bohm | |
| 2011/0272573 | A1 | 11/2011 | Kostrzewa et al. | |
| 2011/0284737 | A1 | 11/2011 | Makarov et al. | |
| 2012/0145889 | A1 * | 6/2012 | Vestal | H01J 49/403 250/282 |
| 2012/0145893 | A1 * | 6/2012 | Vestal | H01J 49/403 250/286 |
| 2014/0175274 | A1 | 6/2014 | Makarov et al. | |
| 2015/0028197 | A1 | 1/2015 | Grinfeld et al. | |
| 2016/0111271 | A1 | 4/2016 | Bohm | |

FOREIGN PATENT DOCUMENTS

| | | | |
|---|---|---|---|
| GB | 2467221 | A | 1/2009 |
| GB | 2478300 | A | 9/2011 |
| GB | 2563604 | A | 12/2018 |
| SU | 1725289 | A1 | 4/1992 |
| WO | 2008047891 | A2 | 4/2008 |
| WO | 2015185941 | A1 | 12/2015 |

OTHER PUBLICATIONS

Combined Search and Examination Report dated Aug. 31, 2020, issued to GB Patent Application No. 2002968.2.

* cited by examiner

TIME OF FLIGHT MASS SPECTROMETER AND METHOD OF MASS SPECTROMETRY

CROSS-REFERENCE TO RELATED APPLICATIONS

This application claims priority to GB Patent Application No. 2002968.2, filed on Mar. 2, 2020, which is hereby incorporated by reference in its entirety.

FIELD OF INVENTION

The present disclosure relates to the field of time of flight mass spectrometry. Aspects of the disclosure relate to time of flight mass spectrometers and methods of time of flight mass spectrometry.

BACKGROUND OF THE INVENTION

Time of flight (ToF) mass spectrometers are widely used to determine the mass to charge ratio (m/z) of ions on the basis of their flight time along a flight path. In ToF mass spectrometers, short ion pulses are generated by a pulsed ion injector to form an ion beam that is directed along a prescribed ion flight path through an evacuated space to reach an ion detector. The ions in each ion pulse become separated based on their time of flight along the flight path, which is dependent on the ions' m/z, and arrive at the detector as time-separated short ion packets of different m/z. The detector detects the arrival times of the ions, along with the abundance of the arriving ions, and stores this data in a data acquisition system. A mass spectrum can be generated from the acquired ToF data.

Improved m/z resolution (also termed mass resolution) is an important attribute for a mass spectrometer for a wide range of applications, particularly with regard to applications in biological science, such as proteomics and metabolomics for example. Mass resolution in ToF mass spectrometers is known to increase in proportion to the length of the ions' flight path, assuming that ion focal properties remain constant. Thus, flight path extension within ToF mass spectrometers is desirable to increase time of flight separation of ions and thereby improve the ability to distinguish small m/z differences between ions.

Various arrangements are known utilizing single or multiple reflections of ions to extend the flight path of the ions within mass spectrometers without greatly increasing the overall size of the spectrometer. Examples are disclosed in U.S. Pat. No. 9,136,100, SU1725289, GB2478300, GB2403063, WO2008/047891 and U.S. Pat. No. 9,136,101.

Unfortunately, ion energy distributions and space charge interactions can cause ions to spread out in flight, which in long flight systems can cause them to be lost from the analyser or to reach the detector at an aberrant time-of-flight.

Time dependent lens voltages have been proposed for ToF mass spectrometers in U.S. Pat. No. 8,212,209 and US2016/0111271 A1 to address stigmatic focusing and beam broadening with ion mass.

SUMMARY OF THE INVENTION

Against the above background the present disclosure is provided.

Aspects of the present disclosure address the problem that packets of multiply charged ions disperse less in flight and, consequently, can suffer stronger space charge effects as a result of greater charge density. Similarly, ion packets consisting of large numbers of ions can suffer space charge effects as a result of greater charge density. Such space charge effects can reduce the mass resolution of the spectrometer and/or adversely affect ion transmission.

The present disclosure provides in one aspect a time-of-flight mass spectrometer according to claim 1. The present disclosure provides in another aspect a method of time-of-flight mass spectrometry according to claim 24. Other aspects of the disclosure are set out in the further claims and described below.

A time-of-flight mass spectrometer provided by the present disclosure comprises: a pulsed ion injector for forming an ion beam that travels along an ion path; a detector for detecting ions in the ion beam that arrive at the detector at times according to their m/z values; an ion focusing arrangement located between the ion injector and the detector for focusing the ion beam in at least one direction orthogonal to the ion path; and a variable voltage supply for supplying the ion focusing arrangement with at least one variable voltage that is dependent on a charge state and/or an amount of ions of at least one species of ions in the ion beam.

A method of time-of-flight mass spectrometry provided by the present disclosure comprises: forming an ion beam from a pulsed ion injector that travels along an ion path; detecting ions in the ion beam that arrive at a detector at times according to their m/z values; focusing the ion beam in at least one direction orthogonal to the ion path using an ion focusing arrangement located between the ion injector and the detector for; and supplying the ion focusing arrangement with at least one variable voltage from a variable voltage supply, wherein the variable voltage is dependent on a charge state and/or an amount of ions of at least one species of ions in the ion beam.

The time-of-flight mass spectrometer of the present disclosure may be used to perform the method of the present disclosure. The features of the time-of-flight mass spectrometer thus also apply mutatis mutandis to the method.

According to the disclosure, the voltage applied to the ion focusing arrangement can be optimised to the charge state and/or amount of ions of at least one ion species that it is desired to detect. Thus, the applied voltage may be a function of the charge state and/or amount of ions of at least one ion species in the ion beam. The voltage may be a function of the charge state alone, or the amount of ions alone, or both the charge state and the amount of ions of at least one ion species. For example, if multiply charged ions, which disperse less in flight, are desired to be detected, the voltage can be adjusted to a value that increases spatial dispersion of the ions in at least one direction orthogonal to the ion path and thereby reduces the effects of space charge inherent with packets of multiply charged ions. The term multiply charged ions refers to ions with a charge state greater than 1, such as 2+, 3+, 4+ . . . , or 2−, 3−, 4− . . . etc. The spatial dispersion of the multiply charged ions in the beam may be increased by the variable voltage relative to the spatial dispersion of the multiply charged ions when the voltage applied to the ion focusing arrangement is optimised for detection of singly charged ions. Similarly, to optimise detection of ion packets consisting of large numbers of ions (i.e. high peak intensity in the mass spectrum), the voltage similarly can be adjusted to reduce the effects of space charge by increasing spatial dispersion of the ion beam. In this way, the mass resolution and/or ion transmission can be improved for one or more ion species having a multiple charge state and/or a large number of ions. The variable voltage may be adjusted, for example, if the charge state of a species of ions is above a threshold value, such as at least 2 or 3 or 4 or 5 or 10 or 20 (e.g. +2, or +3, or +4, or +5, . . . , or +10, or higher than 10+). The variable voltage may be adjusted, for example, if the amount of a species of ions is above a threshold value (e.g. the peak has a Signal/Noise (S/N) value or an intensity above a threshold, which may give rise to (preferably has been determined to give rise to) undesired space charge effects).

The charge state of the species of ions can be obtained in different ways. The charge state can be an approximate value of the charge state or an accurate value. The charge state can be a predicted or measured charge state. The charge state of the ions can be predicted, e.g. from prior knowledge of the type of sample used to generate the ions. A charge state for product ions in MS2 can be predicted from measured precursor charge states. The charge state of the ions can be measured, e.g. from analysis of a mass spectrum acquired by the detector. Routinely used algorithms, such as THRASH and Advanced Peak Detection, can be used to determined charge states of ions from spectra. Charge states may be inferred from the mass spacing of different isotopic species, or from the spacing of different charge states of the same ion. The amount of ions of a species of ions can be obtained in different ways, e.g. from the measured peak intensity of the species of ions in the mass spectrum acquired by the detector. In some embodiments, therefore, a pre-scan (i.e. mass spectrum) is first acquired to obtain data on the charge state and/or the amount of ions of at least one species of ions in the ion beam. The data is then used to control the variable voltage supply accordingly.

The time-of-flight mass spectrometer typically further comprises a controller configured to use data on at least one charge state and/or amount of at least one ion species in the ion beam (referred to herein as charge state data and peak abundance data respectively) to control the variable voltage supply. The controller typically uses control signals to control the variable voltage supply. The controller typically comprises a computer. The computer is typically programmed to control the variable voltage supply according to data on at least one charge state and/or amount of at least one ion species in the ion beam. The controller may be configured to predict at least one charge state of product ions in an MS2 analysis from at least one charge state of parent ions acquired in an MS1 analysis. The charge state of parent ions may be acquired in the MS1 analysis from analysis of the mass spectra, e.g. using THRASH or Advanced Peak Detection. The charge state of product ions may be predicted, for example, using fragmentation knowledge or rules about the fragmentation behaviour of parent ions. The controller, for example the computer thereof, may be communicatively coupled to the detector so that data acquired by the detector on at least one charge state and/or amount of at least one ion species in the ion beam can be used by the controller to control the variable voltage supply.

The voltage supply may be configured to vary the voltage supplied to the ion focusing arrangement based on charge state data and/or peak abundance data acquired by the detector and/or a charge measurement device for measuring charge in the ion beam. The charge measurement device is preferably located upstream of the ion focusing arrangement and may be located in or adjacent the ion path. The charge measurement device may comprise, for example, a grid located in the ion path or an image current measuring device located adjacent the ion path.

The voltage supply may be configured to vary the voltage supplied to the ion focusing arrangement from one m/z scan of an ion pulse from the ion injector to a subsequent scan of another ion pulse from the ion injector. A scan comprises the detection of the ions in a single pulse. That is, the voltage may be varied from scan to scan.

The voltage supply may be configured to vary the voltage supplied to the ion focusing arrangement within an m/z scan of a pulse of ions from the ion injector. That is, the voltage may be varied within a single scan. For example, the voltage may be varied synchronously with the arrival of an ion species at the ion focusing arrangement.

The voltage supply may be configured to vary the voltage supplied to the ion focusing arrangement based on charge state data and/or peak abundance data of ions in the ion beam acquired from a pre-scan of a pulse of ions from the ion injector (i.e. a pre-scan of ions of the same sample).

The voltage supply may be configured to vary the voltage supplied to the ion focusing arrangement based on data on a charge state and/or an amount of at least one species of ions in the ion beam acquired from the ions on the fly during an m/z scan of a pulse of ions from the ion injector, for example using an upstream charge measurement device. The at least one variable voltage may be variable in a time dependent manner correlated to the arrival times at the focusing arrangement of ions of different charge state and/or different space charge.

The voltages to be applied based on a charge state and/or a number of ions of at least one ion species may be determined by a calibration procedure. For example, one or more calibration mixtures may be ionised to provide one or more calibration mixtures of ions, which are mass analysed by the spectrometer, i.e. detected by the detector according to m/z. The calibration mixtures typically contain known mixtures of different molecular species that form ions of known m, z and m/z. An example of a calibration mixture is Pierce™ FlexMix™ Calibration Solution available from Thermo Fisher Scientific™, which is a mixture of 16 highly pure, ionisable components (mass ranges: 50 to 3000 m/z) designed for both positive and negative ionisation calibration, largely providing singly charged ions. Calibration solutions for providing multiply charged ions can contain a protein mixture for example; commonly used proteins in calibration solutions include ubiquitin, myoglobin, cytochrome C and/or carbonic anhydrase but many other proteins and/or peptides can be used in the calibration mixtures as required. For example, Pierce™ Retention Time Calibration Mixture contains a mixture of 15 known peptides. The calibration mixtures preferably contain molecular species that produce ions having a range of different masses, charges states and abundances (peak intensities), especially a range that covers most masses, charges states and ion abundances expected in samples to be analysed by the spectrometer. Thus, the calibration mixtures of ions contain at least different charge states and/or amounts of ions for at least two different species of ions, preferably at least five, or at least 10 different species of ions.

The calibration procedure may comprise mass analysis (recording mass spectra) of the one or more calibration mixtures of ions performed at varying voltages applied to the ion focusing arrangement to determine the dependence of the recorded m/z values and peak intensities in the spectra on the voltage variation for different ion masses (m), charge states (z) and peak intensities. A multi-dimensional data set is thereby produced. Optimum voltages for applying to the ion focusing arrangement for ions of given m, z, and/or intensity can thereby be obtained. In some aspects of this disclosure, additional or alternative calibration procedures using one or more calibration mixtures may be carried out, wherein a dependence of the recorded m/z values and peak intensities is determined for pressure and/or voltage variations in the ion injector (ion trap). The aforementioned dependencies may be approximated by functions (e.g. smooth functions, such as splines). The computer-comprising controller may determine such functions. The functions may be used to adjust the variable voltage etc. dependent on the charge state, ion number etc. The approximation functions may be used for correction of acquired mass spectra, e.g. prior to saving the spectra. Preferably, determined multi-dimensional dependencies may be approximated by such functions (e.g. splines) and used for online correction of acquired mass spectra prior to saving them.

Accordingly, in one aspect, the disclosure provides a method of mass spectrometry as described, wherein the dependence of the at least one variable voltage on the charge state and/or the amount of ions of at least one species of ions in the ion beam has been determined from a calibration, wherein the calibration comprises detecting one or more calibration mixtures of ions with varying voltages supplied to the ion focusing arrangement to determine a dependence of detected m/z values and/or peak intensities on the variable voltage for different charge states and/or amounts of ions.

The charge state of the at least one species of ions may comprise a multiply charged state and the voltage supply may be configured to vary the voltage supplied to the ion focusing arrangement to normalize a spatial dispersion of the ions of the multiply charged state to a spatial dispersion of singly charged ions. In other words, the voltage supplied to the ion focusing arrangement may be adjusted such as to make the spatial dispersion of the multiple charged ion species substantially the same as the average spatial dispersion for singly charged ions.

In some embodiments, the at least one charge state may be a charge state of a single ion species. In some other embodiments, the at least one charge state may be a plurality of charge states of different ion species. The at least one charge state may comprise a representative charge state of a plurality of different ion species. For example, the representative charge state may be an average charge state of a plurality of different ion species having different charge states. In this way, the voltage applied may be a compromise between optimum voltages for a number of different ion species having different charge states. Similarly, in certain embodiments, the at least one amount of ions may be an amount of ions of a single ion species. In certain other embodiments, the at least amount of ions may be a plurality of amount of ions of different ion species. The at least one amount of ions may comprise a representative amount of ions of a plurality of different ion species. For example, the representative amount of ions may be an average amount of ions of a plurality of different ion species having different amounts of ions present in the ion beam (different abundances). In this way, the voltage applied may be a compromise between optimum voltages for a number of different ion species having different abundances.

The ion beam may undergo one or more reflections, preferably multiple reflections along the ion path. The ion beam path may follow a zigzag path in some multiple reflection embodiments. The ion path may lie in a plane and the focusing arrangement may focus the ion beam in a direction (orthogonal to the ion path) that lies within the plane and/or in a direction out of the plane. The time-of-flight mass spectrometer accordingly preferably further comprises at least one ion mirror configured to reflect the ion beam along the ion path. The time-of-flight mass spectrometer also preferably further comprises a plurality of ion mirrors configured to reflect the ion beam a plurality of times along the ion path. Thus, the time-of-flight mass spectrometer may be a single reflection or multiple reflection time-of-flight mass spectrometer.

In some embodiments, the time-of-flight mass spectrometer may comprise two ion mirrors spaced apart and opposing each other in a direction X, each mirror elongated generally along a drift direction Y, the drift direction Y being orthogonal to the direction X, configured to provide a zigzag ion path by reflecting the ion beam multiple times between the ion mirrors in the direction X whilst the ion beam drifts in the drift direction Y. Such spaced apart mirrors may be parallel or non-parallel (i.e. tilted) to each other. The ion path may lie in the X-Y plane and the focusing arrangement may be for focusing the ion beam in a direction that lies within the X-Y plane and/or in a direction out of the plane. The pulsed ion injector may inject pulses of ions into the space between the ion mirrors at a non-zero inclination angle to the X direction, the ions thereby forming an ion beam that follows a zigzag ion path and undergoes N reflections between the ion mirrors in the direction X whilst drifting along the drift direction Y. N is an integer value of at least 2. Thus, the ion beam undergoes at least 2 reflections between the ion mirrors in the direction X whilst drifting along the drift direction Y. Preferably, the number N of ion reflections in the ion mirrors along the ion path from the ion injector to the detector is at least 3, or at least 10 or at least 30, or at least 50, or at least 100. Preferably, the number N of ion reflections in the ion mirrors along the ion path from the ion injector to the detector is from 2 to 100, 3 to 100, or 10 to 100, or over 100, e.g. one of the groups: (i) from 3 to 10; (ii) from 10 to 30; (iii) from 30 to 100; (iv) over 100. Ions injected into the spectrometer are preferably repeatedly reflected back and forth in the X direction between the mirrors, whilst they drift down the Y direction of mirror elongation (in the +Y direction). In certain embodiments, after a number of reflections (typically N/2), the ions can be reversed in their drift velocity along Y so they are repeatedly reflected back and forth in the X direction between the mirrors whilst they drift back along the Y direction (in the −Y direction) before detection by the detector. Such arrangements of ion mirrors are disclosed in U.S. Pat. No. 9,136,101, the contents of which is incorporated in its entirety herein.

The ion focusing arrangement typically comprises or is at least one ion focusing lens. Accordingly, the voltage supply is for supplying at least one variable voltage to the at least one ion focusing lens. The at least one ion focusing lens may be selected from the following types of lenses: a trans-axial lens, an Einzel lens, and a multipole lens. The at least one ion focusing lens may be located before a first reflection in the ion mirror(s). In such embodiments, the time-of-flight mass spectrometer may have only a single ion mirror. More generally in these types of embodiments, the spectrometer may comprise at least one ion mirror along the ion path configured to reflect the ion beam, wherein the at least one ion focusing lens is located before a first reflection in the at least one ion mirror. The at least one ion focusing lens may be located after a first reflection and before a fifth reflection in the ion mirrors. In such embodiments, the time-of-flight mass spectrometer has a plurality of ion mirrors (e.g. two opposing ion mirrors) configured to reflect the ion beam a plurality of times such that the beam undergoes multiple, preferably five or more, reflections in the ion mirrors.

Preferably, the ion focusing lens, or lenses where more than one focusing lens is present, comprises a trans-axial lens, wherein the trans-axial lens comprises a pair of opposing lens electrodes positioned either side of the beam, for example either side of the beam in a direction Z, wherein Z is perpendicular to directions X and Y that define the plane of the ion path. Preferably, each of the opposing lens electrodes comprises a circular, elliptical, quasi-elliptical or arc-shaped electrode. In some embodiments, each of the pair of opposing lens electrodes comprises an array of electrodes separated by a resistor chain to mimic a field curvature created by an electrode having a curved edge. In some embodiments, the opposing lens electrodes are each placed within an electrically grounded assembly. In some embodiments, the lens electrodes are each placed within but insulated from a deflector electrode. Each deflector electrode may be placed within an electrically grounded assembly. The deflector electrodes may have an outer trapezoid shape that acts as a deflector of the ion beam. In some embodiments, the ion focusing lens comprises a multipole rod assembly. In some embodiments, the ion focusing lens comprises an Einzel lens (a series of electrically biased apertures).

In some preferred embodiments, the ion focusing arrangement may comprise more than one focusing lens. For example, the ion focusing arrangement may comprise a first focusing lens and a second focusing lens spaced apart from the first focusing lens. The first and second focusing lenses may have different variable voltages applied to them by the variable voltage supply. For example, the first focusing lens may be a diverging lens in a direction orthogonal to the ion path and the second focusing lens may be a converging lens in the direction orthogonal to the ion path, the second focusing lens being downstream of the first focusing lens. In some embodiments, the ion focusing arrangement comprises a first focusing lens positioned before a first reflection in the ion mirrors, especially wherein the first focusing lens is a diverging lens, and a second focusing lens positioned after the first reflection in the ion mirrors for focusing the ion beam, wherein the second focusing lens is a converging lens (i.e. has a converging effect on the ion beam width, orthogonal to the ion path).

The time-of-flight mass spectrometer may further comprise an ion fragmentation device, e.g. collision induced dissociation (CID) cell or electron transfer dissociation (ETD) cell or other dissociation cell, located upstream of the ion injector for performing MS2 analysis of ions, wherein the voltage supply is configured to vary the voltage supplied to the ion focusing arrangement in an MS2 analysis based on data on a charge state and/or an amount of at least one species of product ions derived from MS1 analysis of ions performed prior to the MS2 analysis. In this way, adjustment of the focusing and ion beam dispersion in an MS2 (production) scan may be based on charge state or abundance data acquired from a prior MS1 (precursor ion) scan.

The pulsed ion injector may comprise an ion trap having pulsed ejection of ions, an orthogonal accelerator, MALDI source, secondary ion source (SIMS source), or other known pulsed ion injector for a ToF mass spectrometer. Preferably, the ion injector comprises a pulsed ion trap, more preferably a linear ion trap, such as a rectilinear ion trap or a curved linear ion trap (C-Trap).

The pulsed ion injector generally receives ions from an ion source, whether directly or indirectly via one or more ion optical devices (e.g. one or more of: an ion guide, ion lens, mass filter, collision cell etc.). The ion source ionises a sample to form the ions. Suitable ion sources are well known in the art. In some embodiments, the ion injector itself can be the ion source (e.g. a MALDI source). The ion source may ionise multiple sample species to form the ions, e.g. separated sample species from a chromatograph. The ions can be generated from a sample by any of the following non-exhaustive list of ion sources: electrospray ionisation (ESI), atmospheric pressure chemical ionisation (APCI), atmospheric pressure photoionisation (APPI), atmospheric pressure gas chromatography (APGC) with glow discharge, AP-MALDI, laser desorption (LD), inlet ionization, DESI, laser ablation electrospray ionisation (LAESI), inductively coupled plasma (ICP), laser ablation inductively coupled plasma (LA-ICP) source, etc. Any of these ion sources can be interfaced to any of the following non-exhaustive list of sample separations upstream of the ion source: liquid chromatography (LC), ion chromatography (IC), gas chromatography (GC), capillary zone electrophoresis (CZE), two dimensional GC (GC×GC), two dimensional LC (LC×LC), etc.

The pulsed ion injector produces discrete pulses of ions, i.e. it injects non-continuous pulses of ions, rather than a continuous stream of ions. As known in the art of ToF mass spectrometry, the pulsed ion injector forms short ion pulses comprising at least a portion of said ions from the sample/ion source. Typically, an acceleration voltage is applied to the ion injector to inject the ions into the mirrors, which voltage can be several kV, such as 1 kV, 2 kV, 3 kV, 4 kV, or 5 kV, or higher.

The ion focusing arrangement may be at least partly located between the opposing ion mirrors. In some embodiments, the ion focusing arrangement is located wholly between the mirrors (i.e. in the space between the mirrors), and in other embodiments the ion focusing arrangement is located partly between the mirrors and partly outside the space between the mirrors. For example, one lens of the ion focusing arrangement can be located outside of the space between the ion mirrors while another lens of the ion focusing arrangement is located between the ion mirrors.

The detector may comprise a suitable ion detector known in the art for ToF mass spectrometry. Examples include secondary electron multiplier (SEM) detectors or microchannel plates (MCP) detectors, or detectors incorporating SEM or MCP combined with a scintillator/photodetector.

The ion mirror(s) may comprise any known type of elongated ion mirror. The ion mirror(s) is or are typically electrostatic ion mirrors. The mirror(s) may be gridded or the mirror(s) may be gridless. Preferably the mirror(s) is or are gridless. The ion mirror(s) typically is or are planar ion mirror(s), especially electrostatic planar ion mirror(s). In some embodiments, two planar ion mirrors are parallel to each other, for example over the majority or the entirety of their length in the drift direction Y. In some embodiments, the ion mirrors may not be parallel over a short length in the drift direction Y (e.g. at their entrance end closest to the ion injector as in US 2018-0138026 A). The mirrors are typically substantially the same length in the drift direction Y. The ion mirrors are preferably separated by a region of electric field free space. The ion optical mirrors oppose one another. By opposing mirrors it is meant that the mirrors are oriented so that ions directed into a first mirror are reflected out of the first mirror towards a second mirror and ions entering the second mirror are reflected out of the second mirror towards the first mirror. The opposing mirrors therefore have components of electric field which are generally oriented in opposite directions and facing one another. Each planar mirror is preferably made of a plurality of elongated parallel bar electrodes, the electrodes elongated generally in the direction Y. Such constructions of mirrors are known in the art, for example as described in SU172528 or US2015/0028197. The elongated electrodes of the ion mirrors may be provided as mounted metal bars or as metal tracks on a PCB base. The elongated electrodes may be made of a metal having a low coefficient of thermal expansion such as Invar such that the time of flight is resistant to changes in temperature within the instrument. The electrode shape of the ion mirrors can be precisely machined or obtained by wire erosion manufacturing. The mirror length (total length of both first and second stages) is not particularly limited in the invention but preferred practical embodiments have a total length in the range 300-500 mm, more preferably 350-450 mm.

The two ion mirrors each may be elongated predominantly in one direction Y. The elongation may be linear (i.e. straight), or the elongation may be non-linear (e.g. curved or comprising a series of small steps so as to approximate a curve), as will be further described. The elongation shape of each mirror may be the same or it may be different. Preferably the elongation shape for each mirror is the same. Preferably the mirrors are a pair of symmetrical mirrors. Where the elongation is linear, the mirrors can be parallel to each other, although in some embodiments, the mirrors may not be parallel to each other.

As herein described, the two mirrors are aligned to one another so that they lie in the X-Y plane and so that the elongated dimensions of both mirrors lie generally in the drift direction Y. The mirrors are spaced apart and oppose one another in the X direction. The distance or gap between the ion mirrors can be conveniently arranged to be constant as a function of the drift distance, i.e. as a function of Y, the elongated dimension of the mirrors. In this way the ion mirrors are arranged parallel to each other. However, in some embodiments, the distance or gap between the mirrors can be arranged to vary as a function of the drift distance, i.e. as a function of Y, the elongated dimensions of both mirrors will not lie precisely in the Y direction and for this reason the mirrors are described as being elongated generally along the drift direction Y. Thus, being elongated generally along the drift direction Y can also be understood as being elongated primarily or substantially along the drift direction Y. In some embodiments of the invention the elongated dimension of at least one mirror may be at an angle to the direction Y for at least a portion of its length.

The mechanical construction of the mirrors themselves may appear, under superficial inspection, to maintain a constant distance apart in X as a function of Y, whilst the average reflection surfaces may actually be at differing distances apart in X as a function of Y. For example, one or more of the opposing ion mirrors may be formed from conductive tracks disposed upon an insulating former (such as a printed circuit board) and the former of one such mirror may be arranged a constant distance apart from an opposing mirror along the whole of the drift length whilst the conductive tracks disposed upon the former may not be a constant distance from electrodes in the opposing mirror. Even if electrodes of both mirrors are arranged a constant distance apart along the whole drift length, different electrodes may be biased with different electrical potentials within one or both mirrors along the drift lengths, causing the distance between the opposing average reflection surfaces of the mirrors to vary along the drift length. Thus, the distance between the opposing ion-optical mirrors in the X direction varies along at least a portion of the length of the mirrors in the drift direction.

In some embodiments, the mass spectrometer of the present invention includes one or more compensation electrodes in the space between the mirrors to minimise the impact of time of flight aberrations caused by for example mirror misalignment, for example as described in U.S. Pat. No. 9,136,102, the contents of which is incorporated herein in its entirety. The compensation electrodes extend along at least a portion of the drift direction in or adjacent the space between the mirrors. In some embodiments, the compensation electrodes create components of electric field which oppose ion motion along the +Y direction along at least a portion of the ion optical mirror lengths in the drift direction. These components of electric field preferably provide or contribute to a returning force upon the ions as they move along the drift direction. The one or more compensation electrodes may be of any shape and size relative to the mirrors of the multi-reflection mass spectrometer. In preferred embodiments the one or more compensation electrodes comprise extended surfaces parallel to the X-Y plane facing the ion beam, the electrodes being displaced in +/−Z from the ion beam flight path, i.e. each one or more electrodes preferably having a surface substantially parallel to the X-Y plane, and where there are two such electrodes, preferably being located either side of a space extending between the opposing mirrors. In another preferred embodiment, the one or more compensation electrodes are elongated in the Y direction along a substantial portion of the drift length, each electrode being located either side of the space extending between the opposing mirrors. In this embodiment preferably the one or more compensation electrodes are elongated in the Y direction along a substantial portion, the substantial portion being at least one or more of: 1/10; 1/5; 1/4; 1/3; 1/2; 3/4 of the total drift length. In some embodiments, the one or more compensation electrodes comprise two compensation electrodes elongated in the Y direction along a substantial portion of the drift length, the substantial portion being at least one or more of: 1/10; 1/5; 1/4; 1/3; 1/2; 3/4 of the total drift length, one electrode displaced in the +Z direction from the ion beam flight path, the other electrode displaced in the −Z direction from the ion beam flight path, the two electrodes thereby being located either side of a space extending between the opposing mirrors. However other geometries are anticipated. Preferably, the compensation electrodes are electrically biased in use such that the total time of flight of ions is substantially independent of the incidence angle of the ions. As the total drift length travelled by the ions is dependent upon the incidence angle of the ions, the total time of flight of ions is substantially independent of the drift length travelled.

Compensation electrodes may be biased with an electrical potential. Where a pair of compensation electrodes is used, each electrode of the pair may have the same electrical potential applied to it, or the two electrodes may have differing electrical potentials applied. Preferably, where there are two electrodes, the electrodes are located symmetrically either side of a space extending between the opposing mirrors and the electrodes are both electrically biased with substantially equal potentials. In some embodiments, one or more pairs of compensation electrodes may have each electrode in the pair biased with the same electrical potential and that electrical potential may be zero volts with respect to what is herein termed as an analyser reference potential. Typically the analyser reference potential will be ground potential, but it will be appreciated that the analyser may be arbitrarily raised in potential, i.e. the whole analyser may be floated up or down in potential with respect to ground. As used herein, zero potential or zero volts is used to denote a zero potential difference with respect to the analyser reference potential and the term non-zero potential is used to denote a non-zero potential difference with respect to the analyser reference potential. Typically the analyser reference potential is, for example, applied to shielding such as electrodes used to terminate mirrors, and as herein defined is the potential in the drift space between the opposing ion optical mirrors in the absence of all other electrodes besides those comprising the mirrors.

In certain embodiments, two or more pairs of opposing compensation electrodes are provided. In such embodiments, pairs of compensation electrodes in which each electrode is electrically biased with zero volts are further referred to as unbiased compensation electrodes, and other pairs of compensation electrodes having non-zero electric potentials applied are further referred to as biased compensation electrodes. Typically the unbiased compensation electrodes terminate the fields from biased compensation electrodes. In one embodiment, surfaces of at least one pair of compensation electrodes have a profile in the X-Y plane, such that the said surfaces extend towards each mirror a greater distance in the regions near one or both the ends of the mirrors than in the central region between the ends. In another embodiment, at least one pair of compensation electrodes have surfaces having a profile in the X-Y plane, such that the said surfaces extend towards each mirror a lesser distance in the regions near one or both the ends of the mirrors than in the central region between the ends. In such embodiments preferably the pair(s) of compensation electrodes extend along the drift direction Y from a region adjacent an ion injector at one end of the elongated mirrors, and the compensation electrodes are substantially the same length in the drift direction as the extended mirrors, and are located either side of a space between the mirrors. In alternative embodiments, the compensation electrode surfaces as just described may be made up of multiple discrete electrodes.

Preferably, in all embodiments of the present invention, the compensation electrodes do not comprise ion optical mirrors in which the ion beam encounters a potential barrier at least as large as the kinetic energy of the ions in the drift direction. However, as has already been stated and will be further described, they preferably create components of electric field which oppose ion motion along the +Y direction along at least a portion of the ion optical mirror lengths in the drift direction.

Preferably the one or more compensation electrodes are, in use, electrically biased so as to compensate for at least some of the time-of-flight aberrations generated by the opposing mirrors. Where there is more than one compensation electrode, the compensation electrodes may be biased with the same electrical potential, or they may be biased with different electrical potentials. Where there is more than one compensation electrode one or more of the compensation electrodes may be biased with a non-zero electrical potential whilst other compensation electrodes may be held at another electrical potential, which may be zero potential. In use, some compensation electrodes may serve the purpose of limiting the spatial extent of the electric field of other compensation electrodes.

In some embodiments, one or more compensation electrodes may comprise a plate coated with an electrically resistive material which has different electrical potentials applied to it at different ends of the plate in the Y direction, thereby creating an electrode having a surface with a varying electrical potential across it as a function of the drift direction Y. Accordingly, electrically biased compensation electrodes may be held at no one single potential. Preferably the one or more compensation electrodes are, in use, electrically biased so as to compensate for a time-of-flight shift in the drift direction generated by misalignment or manufacturing tolerances of the opposing mirrors and so as to make a total time-of-flight shift of the system substantially independent of such misalignment or manufacturing.

The electrical potentials applied to compensation electrodes may be held constant or may be varied in time. Preferably the potentials applied to the compensation electrodes are held constant in time whilst ions propagate through the multi-reflection mass spectrometer. The electrical bias applied to the compensation electrodes may be such as to cause ions passing in the vicinity of a compensation electrode so biased to decelerate, or to accelerate, the shapes of the compensation electrodes differing accordingly, examples of which will be further described. As herein described, the term "width" as applied to compensation electrodes refers to the physical dimension of the biased compensation electrode in the +/−X direction. It will be appreciated that potentials (i.e. electric potentials) and electric fields provided by the ion mirrors and/or potentials and electric fields provided by the compensation electrodes are present when the ion mirrors and/or compensation electrodes respectively are electrically biased.

The biased compensation electrodes located adjacent or in the space between the ion mirrors can be positioned between two or more unbiased (grounded) electrodes in the X-Y plane that are also located adjacent or in the space between the ion mirrors. The shapes of the unbiased electrodes can be complementary to the shape of the biased compensation electrodes.

In some embodiments, the space between the opposing ion optical mirrors is open ended in the X-Z plane at each end of the drift length. By open ended in the X-Z plane it is meant that the mirrors are not bounded by electrodes in the X-Z plane which fully or substantially span the gap between the mirrors.

DETAILED DESCRIPTION OF EMBODIMENTS

Figure 1:
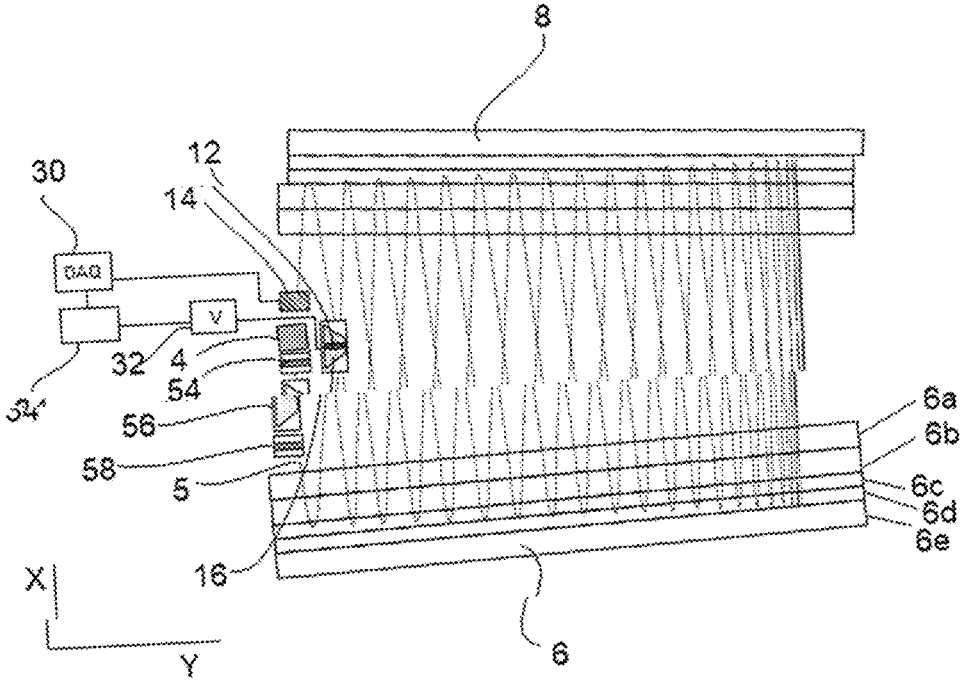
FIG. 1 shows schematically a time of flight mass spectrometer according to an embodiment of the present disclosure.

Various embodiments of mass spectrometers and methods of mass spectrometry according to aspects of the present disclosure will now be described with reference to the accompanying figures. The embodiments are intended to illustrate various features and are not intended to be limiting on the scope of the disclosure. It will be appreciated that variations to the embodiments can be made while still falling within the scope of the appended claims.

There is a commercial need for an extended flight path in a time-of-flight analyser to provide high mass resolution (e.g. >50K) whilst maintaining high ion transmission, mass range and tolerance to space charge. One problem with achieving space charge tolerance is control of ion beam divergence within the analyser, which varies as a function of ion number (amount of ions), as well as ion charge state, as heavy multiply charged ions have lower velocity in directions orthogonal to the beam direction under thermal energy than light singly charged ions of the same mass/charge ratio. Thus, velocity spread in the orthogonal drift dimension is lower for multiply charged ions than light singly charged ions of the same m/z. There is also a difference in the out-of-plane velocity dispersion. The latter can be at least partially controlled by out-of-plane lenses. Beam dispersion may also vary with m/z, with a specific influence caused by RF ion source conditions and by limitations on ion cooling, especially when limited time or gas pressure in the ion source is available to thermalize higher mass ions.

The present disclosure in one aspect provides for charge state correction of ion beam properties. One element of the disclosure is a mass spectrometer that incorporates an ion focusing arrangement to correct for variations in ion beam properties caused by differences in charge state. This may be implemented by applying varying voltages to the ion focusing arrangement or the ion source. Another element is the method by which the ion focusing arrangement is controlled to be optimised for the different charge state distributions that the mass spectrometer may encounter. Information on charge state distributions of sample ions is required to optimise voltage settings prior to ion analysis. In some cases, this information may easily be inferred by knowledge of the sample and/or the application, for example where the spectrometer is employed with one or more charge state filters, such as an ion mobility separator, so that only ions of known charge states are delivered to the mass spectrometer. In some cases, a pre-scan may be performed by the mass spectrometer to determine ion charge states before more optimised analysis is performed using charge state information to vary the focusing voltage to one or more optimum values to acquire mass spectra under conditions optimised for one or more different charge states.

One problem that arises with multiply charged ions is that thermal energies give much lower ion velocities than with singly charged ions. This naturally results in lower ion beam divergence in a time-of-flight analyser, which whilst superficially an attractive property means that space charge effects can be far more severe for multiply charged ions. The influence of low beam divergence compounds the negative space charge effects that occur with the greater number of charges per ion.

For the converging mirror time-of-flight mass analyser disclosed by Grinfeld et al in U.S. Pat. No. 9,136,101B2, the beam divergence is most critical in the drift direction, which lies along the length of the opposing ion mirrors. Herein, in one embodiment, it is proposed to add an ion focusing arrangement comprising an ion focusing lens, also termed a drift focusing lens, to control beam divergence in this dimension.

A multi-reflection mass spectrometer 2 according to an embodiment of the present disclosure is shown schematically in FIG. 1. An amount of ions generated from an ion source (e.g. electrospray ion source, or other ion source), which is not shown, are guided into and trapped in a pulsed ion injector 4. In some embodiments, the ions may be mass selected, e.g. using an upstream quadrupole mass filter, prior to the pulsed ion injector 4. An ion beam, which follows a path 5, is formed by extracting a pulse of trapped, thermalized ions from the pulsed ion injector 4. The beam, for example, has less than 0.5 mm width in the direction Y (the so-called drift direction). The pulse of ions is injected at high energy (e.g. in this embodiment 4 kV) into the space between two opposing elongated mirrors 6, 8 by applying an appropriate extraction voltage to electrodes of the ion injector 4 (e.g. pull/push electrodes) to accelerate the ions out of the ion trap.

Figure 2:
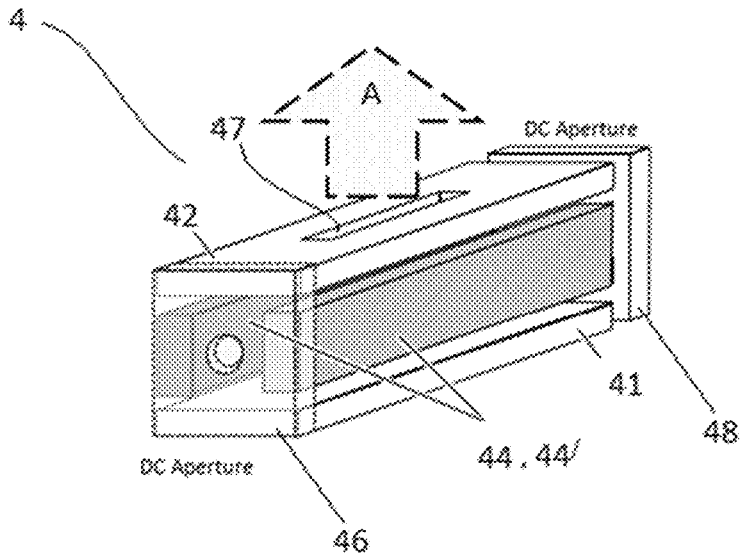
FIG. 2 shows schematically an embodiment of an ion injector in the form of an extraction ion trap.

In this embodiment, the pulsed ion injector 4 is an ion trap. In particular, the ion trap is a linear ion trap, such as a rectilinear ion trap (R-Trap) or a curved linear ion trap (C-trap) for example. The ion trap is also a quadrupole ion trap. An embodiment of a rectilinear ion trap suitable for use as the ion injector 4 is shown in FIG. 2. The ion trap is a linear quadrupole ion trap, which may receive ions generated by an ion source (not shown) and delivered by an interfacing ion optical arrangement (e.g. comprising one or more ion guides and the like) as well understood in the art. The ion trap is composed of a quadruple electrode set. The inscribed radius is 2 mm. Ions are radially confined by opposing RF voltages (1000V at 4 MHz) applied to respective opposite pairs 41, 42 and 44, 44' of the elongated quadruple electrodes; and axially confined by a small DC voltage (+5V) on each of the DC aperture electrodes (46, 48) located at opposing ends of the ion trap. Ions are introduced into the ion trap through the aperture in the DC aperture electrode 46 and are thermalized by collisional cooling with background gas present in the ion trap ($<5\times10^{-3}$ mbar). Before extraction of the cooled ions into the ion mirrors of the mass analyser, the trap potential is raised to 4 kV and then an extraction field is applied by applying −1000V to the pull electrode 42 and +1000V to the push electrode (41), causing positive ions to be expelled through a slot (47) in the pull electrode into the analyser in the direction shown by the arrow A. Alternatively, the rectilinear quadrupole ion trap shown could be replaced by a curved linear ion trap (C-trap) as known in the art.

In addition to the ion injector 4, it is preferred to have several further ion optical elements ("injection optics") to control the injection of ions into the ion mirrors 6, 8. Such ion injection optics may be considered part of the ion focusing arrangement. In the embodiment shown in FIG. 1, out of plane focusing lenses 54, 58 (i.e. focusing in a direction out of the X-Y plane, in other words in the direction Z) are located along the ion path between the ion injector 4 and the first mirror 6. Such out of plane focusing lenses can comprise elongated apertures and improve the transmission of ions into the mirror. Secondly, a portion, e.g. half, of the injection angle of the ion beam to the X direction as it enters the mirror can be provided by the angle of the ion trap to the X direction, and the remainder of the angle, e.g. the other half, can be provided by a deflection caused by at least one deflector 56 located in front of the ion injector 4 (a so-called injection deflector). The out of plane focusing lenses 54, 58 in this embodiment are located before and after the injection deflector 56. The injection deflector is generally positioned before the first reflection in the ion mirrors. The injection deflector can comprise at least one injection deflector electrode (e.g. a pair of electrodes positioned above and below the ion beam). In this way, the isochronous plane of the ions will be correctly aligned to the analyser rather than being, e.g., 2 degrees misaligned with corresponding time-of-flight errors. Such a method is detailed in U.S. Pat. No. 9,136,101. The injection deflector 56 may be a prism type deflector of the types shown in FIG. 5C, with or without incorporating a drift focusing lens.

Figure 3:
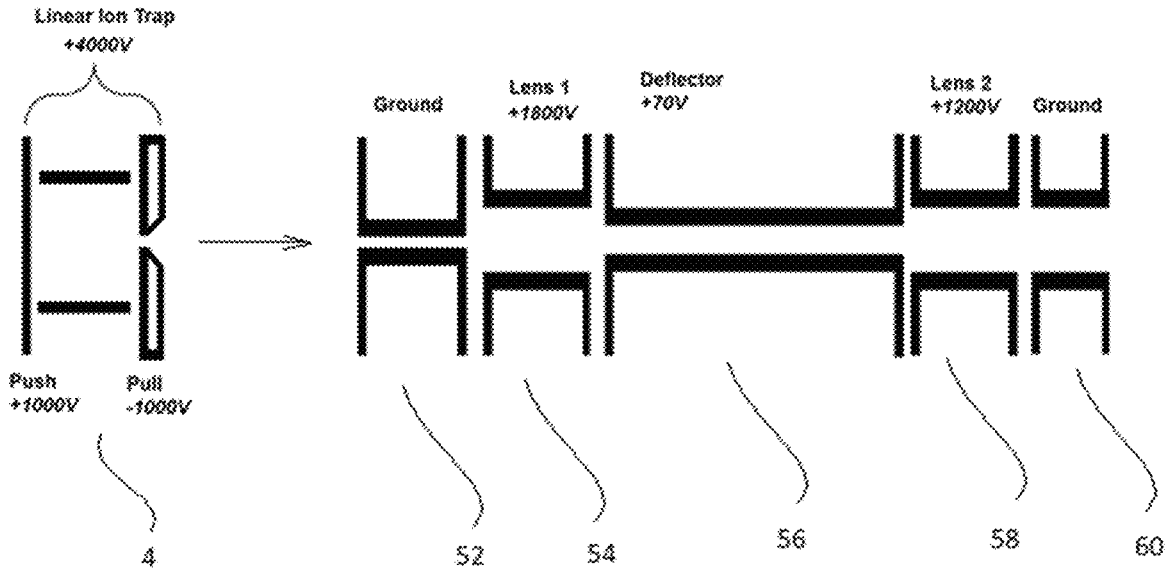
FIG. 3 shows schematically an embodiment of an ion injection optics layout.

In some embodiments, all or a major portion of the injection angle can be provided by injection deflector 56. In addition, it will be appreciated that more than one injection deflector can be used (e.g. in series) to achieve a required injection angle (i.e. it can be seen that the system can include at least one injection deflector, optionally two or more injection deflectors). An example embodiment of an injection optics scheme is shown schematically in FIG. 3, along with suitable applied voltages. The ion injector 4 is a linear ion trap, to which the above described +1000V push and −1000V pull voltages are applied to the 4 kV trap to extract the ion beam. The ion beam shown by the arrow then passes in sequence through ion optics comprising a first ground electrode 52, first lens 54 held at +1800V, ion deflector 56 (+70V) of prism type, second lens 58 held at +1200V and finally a ground electrode 60. The first and second lenses 54, 58 are apertured lenses (rectangular Einzel lenses) for providing out of plane focusing. The deflector 56 provides the inclination angle of the ion beam to the X-axis.

The two ion mirrors 6, 8 are spaced apart and opposing each other in the direction X, each mirror being elongated generally along the drift direction Y, the drift direction Y being orthogonal to the direction X. As described above, the pulsed ion beam is injected into the space between the opposing ion mirrors 6, 8 at an inclination angle to the X direction so the ions have a velocity component in the Y direction. Thereby, the ion beam follows an ion path 5 that is zigzag by reflecting multiple times between the ion mirrors in the direction X whilst the ion beam drifts in the drift direction Y (+Y direction). The ions mirrors 6, 8 are not absolutely parallel but rather are slightly angled to each other (i.e. they converge along the drift direction Y) so that after a certain number of reflections (typically N/2, where N is the total number of reflections between injection and detection of the ions), the ions become reversed in their drift velocity along Y and drift back in the Y direction (in the −Y direction), whilst continuing to be reflected back and forth in the X direction between the mirrors, before detection by a detector 14, located proximate to the ion injector 4. Such arrangements of converging ion mirrors are disclosed in U.S. Pat. No. 9,136,101, the contents of which is incorporated in its entirety herein. Total flight paths of 10 metres or more can be obtained practically by this type of mass spectrometer. The so-called compensation electrodes that are described in U.S. Pat. No. 9,136,101 to compensate for time of flight aberrations are preferably employed with the embodiment shown in FIG. 1 (but are not shown in the figure for clarity).

Preferably, the ToF mass spectrometer is a high resolution mass spectrometer. A high resolution mass spectrometer may have mass resolution greater than 50,000, or 70,000, or 100,000 at m/z 400, for example. The ToF mass spectrometer, preferably, has high mass accuracy, for example with an accuracy being less than 5 ppm, or 3 ppm with external calibration.

The different ion species in the ion beam become separated according to their m/z as they travel from the ion injector 4 to the ion detector 14, so that they arrive at the detector in ascending order of their m/z. The detector is preferably a fast time response detector such as a multi-channel plate (MCP) or dynode electron multiplier with magnetic and electric fields for electron focusing. The ion detector 14 detects the arrivals of the ion species of different m/z and provides signals proportional to the number of ions of each species. A data acquisition system (DAQ) 30, which comprises a computer having at least one processor (not shown), is interfaced to the detector 14 for receiving signals from the detector, and enables determination of the ions' time of flight and thereby a mass spectrum to be produced. The DAQ 30 may comprise a data storage unit (memory) for storing data from the detector, mass spectra etc.

Figure 4:
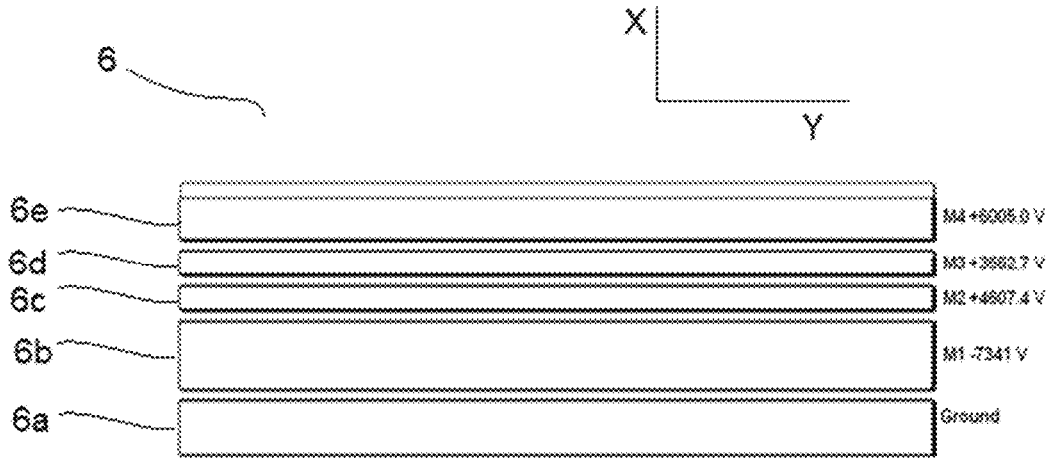
FIG. 4 shows schematically an ion mirror electrode configuration and applied voltages.

Suitable ion mirrors such as 6 and 8 are well understood from the prior art (e.g. U.S. Pat. No. 9,136,101). An example of a configuration of ion mirror is shown schematically in FIG. 4, wherein the ion mirror 6 comprises a plurality of opposing pairs of elongated electrodes spaced apart in the X direction, such as five pairs of elongated electrodes, the first electrode pair 6*a* of the mirror being set to ground potential. In each pair, there is one electrode positioned above the ion beam and one electrode below the beam (i.e. in the Z direction, such that only one electrode of each pair is visible in the Figure). Example of voltages for the set of electrodes (6*a*-6*e*) in order to provide a reflecting potential with a time focus is shown in FIG. 4 with applied voltages being suitable for focusing 4 keV positive ions. For negative ions the polarities can be reversed. As the ion beam enters the first mirror 6, it is focused in the out-of-plane dimension by lensing effected by the first electrode pair 6*a* of the mirror 6, and reflected to a time focus by the remaining electrodes 6*b*-6*e* of the mirror. As an example, the available space between mirrors (i.e. the distance in direction X between the first electrodes (6*a*, 8*a*) of each mirror) is 300 mm and the total effective width of the analyser (i.e. the effective distance in the X direction between the average turning points of ions within the mirrors) is ~650 mm. The total length (i.e. in direction Y) is 550 mm to form a reasonably compact analyser.

After the first reflection in the first ion mirror 6, the ion beam reaches an ion focusing arrangement in the form of a focusing lens 12, which focuses the ion beam in the drift direction Y, i.e. substantially orthogonal to the ion path. The focusing lens 12 may thus be referred to in this embodiment as a drift focusing lens. The focusing lens 12 is located in centrally in the space between the mirrors, i.e. halfway between the mirrors in the direction X, preferably at a time focus. The focusing lens 12 in this embodiment is a trans-axial lens comprising a pair of opposing lens electrodes positioned either side of the beam in a direction Z (perpendicular to directions X and Y). Specifically, the focusing lens 12 comprises a pair of quasi-elliptical plates 12*a*, 12*b* located above and below the ion beam. The lens may be a button-shaped lens. In this embodiment, the plates are 7 mm wide (in X) and 24 mm long (in Y). In various embodiments, the pair of opposing lens electrodes may comprise circular, elliptical, quasi-elliptical or arc-shaped electrodes. The focusing lens 12 may have a converging or diverging effect on the ion beam spatial dispersion depending on the voltage applied to it, i.e. applied to the lens electrodes 12*a*, 12*b*. A voltage is applied to the focusing lens 12, i.e. to the pair of electrodes forming the focusing lens 12, by a variable DC voltage supply 32 that is controlled by a controller 34. The controller 34 comprises a computer and associated control electronics. The same computer may be used for the computer of the DAQ 30 and the computer of the controller 34, or different computers may be used. The computer of the controller 34 runs a computer program which, when executed by one or more processors of the computer, causes the computer (and associated control electronics) to control the mass spectrometer to carry out a method according to the disclosure. The computer program is stored on a computer-readable medium. The controller 34 (e.g. the computer thereof) is further communicatively connected to the data acquisition system 30. As mentioned above, the same computer may be used for the computer of the data acquisition system 30 and the computer of the controller 34.

The concept of placing button shaped electrodes (e.g. circular, oval, elliptical or quasi-elliptical) above and below the ion beam to generate drift focusing in a multi-turn ToF instrument, albeit in a periodic manner and constructed within an orbital geometry, is described in US 2014/175274 A, the contents of which is hereby incorporated by reference in its entirety. Such lenses are a form of "transaxial lens" (see P. W Hawkes and E Kasper, *Principles of Electron Optics* Volume 2, Academic Press, London, 1989, the contents of which is hereby incorporated by reference in its entirety). Such lenses have an advantage of having a wide spatial acceptance, which is important to control an elongated ion beam.

The lenses need to be wide enough to both accommodate the ion beam and so that the 3D field perturbation from the sides of the lens does not damage the focal properties. The space between the electrodes of the transaxial lens should likewise be a compromise between minimising these 3D perturbations and accommodating the height of the beam. In practice, a distance of 4-8 mm between the lens electrodes may be sufficient. A variation in lens curvature from a circular (button) lens to a narrow ellipse shaped lens is possible. A quasi-elliptical structure taking a short arc reduces the time-of-flight aberrations compared to a wider arc or full circle as the path through it is shorter but it requires stronger voltages and at extremes will start to induce considerable lensing out-of-plane. This effect may be harnessed for some combination of control of drift and out-of-plane dispersion in a single lens, but will limit the range of control over each property. As an adjunct, areas where strong fields are already applied, such as the ion extraction region at the ion trap 4, may be exploited via curvature of the ion trap pull/push electrodes to either induce or limit drift divergence of the ion beam. An example of this is the commercial Curved Linear Ion Trap (C-trap) described in US 2011-284737 A, the contents of which is hereby incorporated by reference in its entirety, where an elongated ion beam is focused to a point to aid injection into an Orbitrap™ mass analyser.

Figure 5:
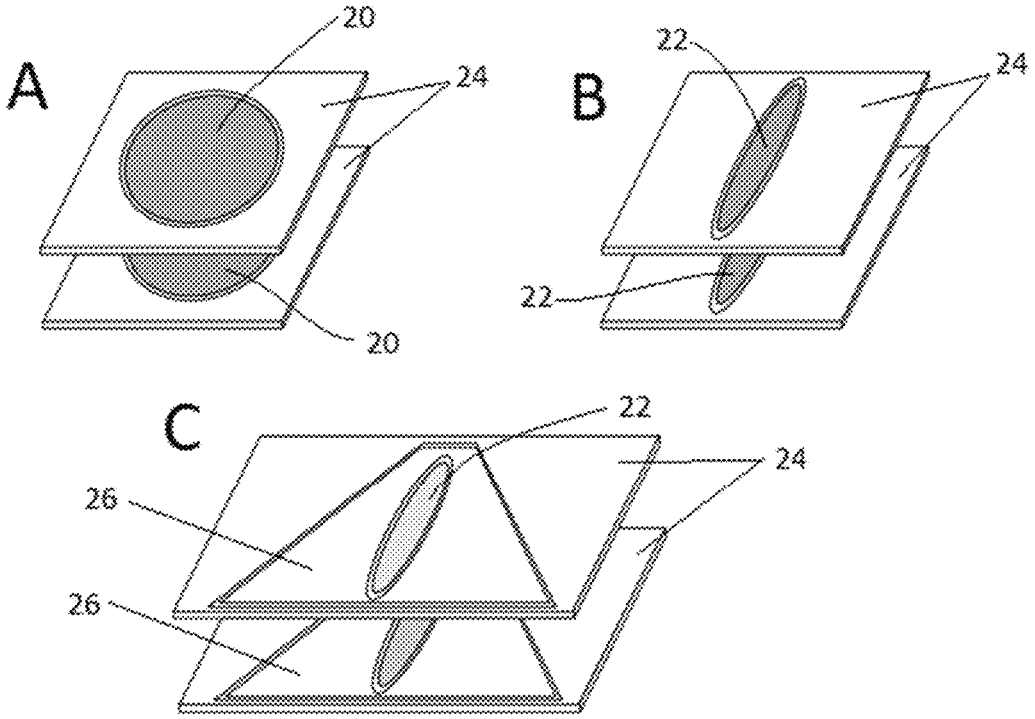
FIG. 5 shows, schematically, shaped ion focusing lenses having circular (A) and elliptical (B) shapes, and a lens integrated into a prism-like deflector (C).

FIG. 5 shows different embodiments (A, B) of drift focusing lenses comprising circular 20 and quasi-elliptical 22 lens plates (electrodes) along with grounded surrounding electrodes 24 for each plate. The lens electrodes 20, 22 are insulated from the grounded surrounding electrodes 24. Also shown (C) is the integration of a lens 22 (in this case of the quasi-elliptical (elliptical or near elliptical) shape but which could be circular etc.) into a deflector, which in this embodiment comprises a trapezoid shaped, prism-like electrode structure 26 arranged above and below the ion beam that serves as a deflector by presenting the incoming ions with a constant field angle rather than a curve. The deflector structure comprises a trapezoid shaped or prism-like electrode arranged above the ion beam and another trapezoid shaped or prism-like electrode arranged below the ion beam. The lens electrodes 22 are insulated from the deflector, i.e. trapezoid shaped, prism-like electrodes, in which they are located, which in turn is insulated from the grounded surrounding electrodes 24. Placement of the lens within a wide spatial acceptance deflector structure is a space efficient design.

Figure 6:
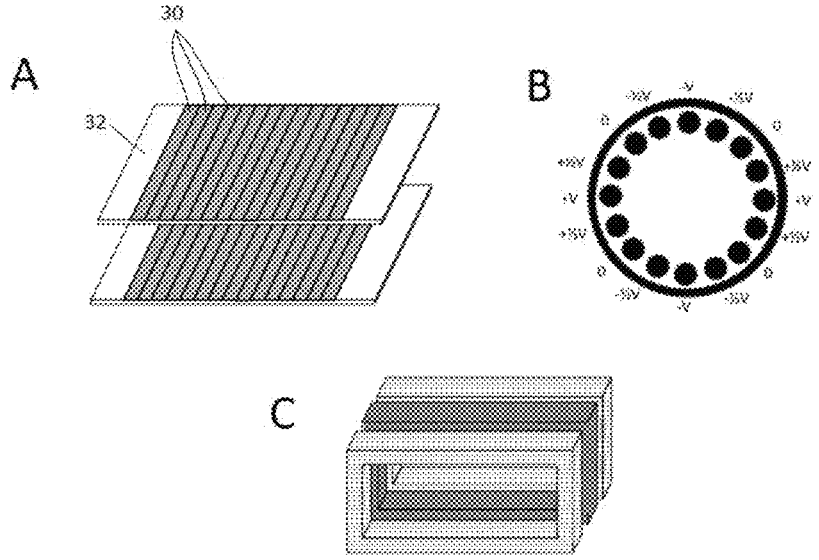
FIG. 6 shows schematically alternative structures for ion focusing lenses.

Other possible embodiments of suitable lens are shown in FIG. 6, for example: an array (A) of mounted electrodes 30 (e.g. mounted on a printed circuit board (PCB) 32) separated by a resistor chain to mimic the field curvature created by shaped electrodes; a multipole rod assembly (B) to create a quadrupole or pseudo-quadrupole field, such as a 12-rod based lens having pseudo-quadrupole configuration with relative rod voltages (V) shown; and an aperture-based lens, such as a normal aperture Einzel-lens structure (C). Such embodiments of focusing lens, e.g. as shown in FIGS. 5 and 6, may be applicable to all embodiments of the ToF mass spectrometer.

The optimum position for the focusing lens 12 may be after the first but before the fourth or fifth reflection in the ion reflection system, i.e. it is positioned relatively early in the system, which has >20 reflections. The optimum position for the focusing lens may be after the first reflection but before the second or third reflection (especially before the second).

FIG. 1 shows the configuration of the converging mirror ToF spectrometer with the focusing lens 12 positioned after the first ion reflection, in this case incorporated within a drift energy reducing deflector 16. It may be preferable that the focusing lens 12, mounted after the first reflection, also incorporates the ion deflector 16, e.g. of the prism type shown in FIG. 5 (embodiment C). This deflector can be tuned to adjust the injection angle to a desired level and/or to correct for any beam deflection imposed by mechanical deviations in the mirrors. Furthermore, errors in mirror manufacture or mounting can induce a small time-of-flight error with every reflection, as ions on one side of the beam see a shorter flight path than the other, and these can preferably corrected by the addition of two compensation electrodes within the space between the mirrors as described above.

In some embodiments, it has been found that an additional focusing lens (focusing in the same drift (Y) direction as the focusing lens 12), mounted between the ion injector 4 and the first reflection and operated in a diverging manner, may be used as it can allow some control of the ion beam divergence before the beam reaches the focusing lens 12. Such additional focusing lens may be mounted within the ion injection deflector 56 as described above and shown in the injection optics scheme of FIG. 3. In certain embodiments, therefore, the ion focusing arrangement can comprise a first focusing lens positioned before the first reflection in the ion mirrors for focusing the ion beam in the drift direction Y, wherein the first focusing lens is preferably a diverging lens, and a second focusing lens 12, positioned after the first reflection in the ion mirrors for focusing the ion beam in the drift direction Y, which may be less diverging on the beam than the first focusing lens or may be converging. The additional focusing lens can be constructed as for the focusing lens 12, e.g. as a trans-axial lens with circular, elliptical or quasi-elliptical shape, such as shown in FIG. 5, or as one of the other types of lens shown in FIG. 6. However, the additional focusing lens typically will have a different voltage applied to it than the focusing lens 12, as it acts on a different width of ion beam and provides different focusing properties.

The ion beam is focused in the out-of-plane (out of X-Y plane) dimension by the pair of lenses 54, 58 and directed into the first ion mirror 6 of two opposing ion mirrors 6, 8. After the first reflection the ions meet the combined deflector/focussing lens 12, 16, whereby the deflector 16 minimises the injection angle (to maximise number of ion reflections within the mirror length), and the lens 12 focuses the ion beam in the Y (drift) direction. The lens 12 can adjust the focusing of the ion beam dependent on a charge state of at least one species of ions in the ion beam that it is desired to accurately detect. The lens 12 preferably normalises the beam spatial dispersion for multiply charged ions to that of singly charged ions. After passing through the focusing lens 12, the beam then enters the second ion mirror 8 and thereafter ions pass back and forth between the two mirrors over a number of reflections as they pass down the drift length. Eventually, the converging mirrors (and additional ToF compensation electrodes (not shown) in FIG. 1) reflect the ions back along the drift direction, where they are finally focused onto the ion detector 14, located proximate to the ion injector 4.

A simulation of the system shown in FIG. 1 has indicated that at the point of maximum beam width divergence, i.e. at the point of reflection in the drift direction Y, singly charged ions reach a width in the drift direction Y of 28 mm full width at half maximum (FWHM) but 10+ ions reach a width of only 7 mm; which results in a huge reduction in space charge tolerance. This can be corrected by applying +70V to the electrodes of the focusing lens 12, compared to 0 V for singly charged ions assuming that the analyser properties without the lens are, by design, tuned to a singly charged thermal distribution of ions, and thus space charge tolerance can be preserved.

Thus, the disclosure provides tuning the focusing lens 12 voltage in a manner dependent on the charge states of the analytes. For example the magnitude of a voltage applied to a converging focusing lens (converging voltage) may be reduced for relatively higher charge states (multiply charged states), or a voltage on a diverging focusing lens (diverging voltage) may be increased for relatively higher charge states, compared to relatively lower charge states (e.g. singly charged state) so that the beam remains optimally or near-optimally diverged for ions having higher charge states. A variation of the voltages applied to the out-of-plane focusing lenses 54, 58 will also have value in maintaining optimal ion beam dispersion orthogonal to the drift direction. However, the focusing in this dimension is less critical for the system shown in FIG. 1, where dispersion in this plane is relatively narrow, but nevertheless may be potentially significant. Thus, the variable voltage may be applied to an ion focusing arrangement that focuses the ion beam in either or both of the directions orthogonal to the ion path. As the ion beam dispersion is controlled in the time-of-flight spectrometer by lenses (e.g. the drift controlling lens 12 and out-of-plane lenses 54, 58 in FIG. 1), it is beneficial to vary the voltages on these lenses to best correct for variations in these properties.

Figure 7:
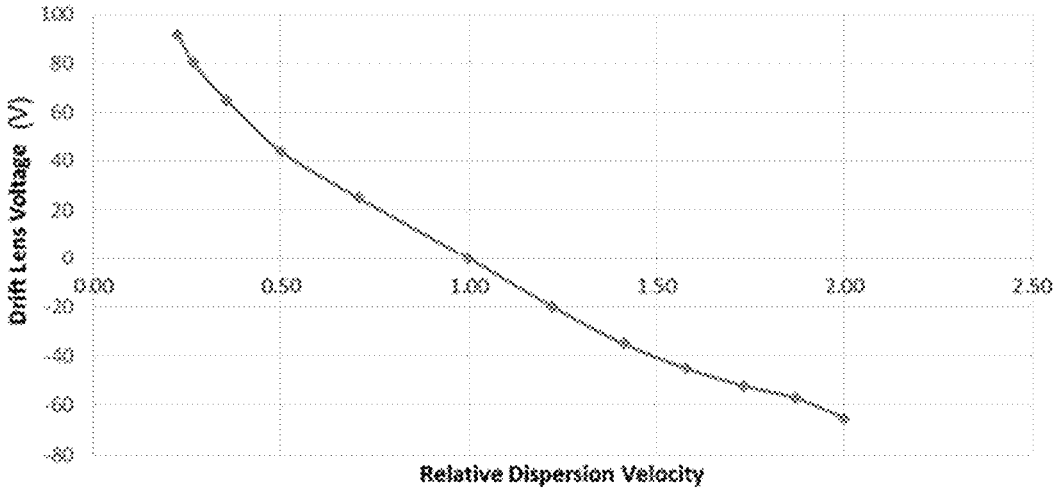
FIG. 7 shows a variation of voltage of an ion focusing lens for a range of different dispersion energies.
Figure 8:
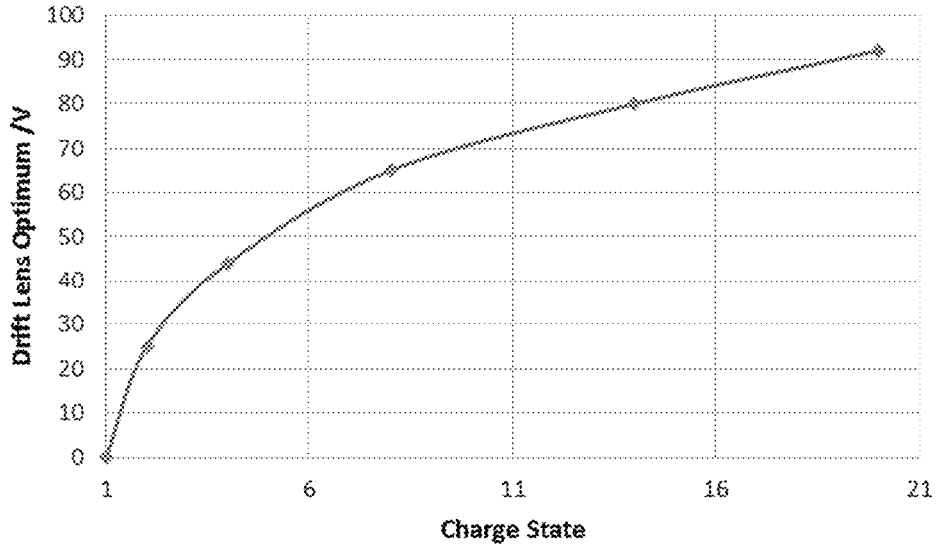
FIG. 8 shows a variation in optimum lens voltage for different ion charge states.

The mass spectrometer shown in FIG. 1 was modelled (using MASIM 3D simulation software) and ion trajectories with varying dispersion energies were simulated. The voltage of the ion drift focusing lens 12 was tuned to an optimum value for a range of different dispersion energies and the resulting trend is shown in FIG. 7 (optimum lens voltage on vertical axis plotted against dispersion velocity on the horizontal axis relative to thermalised, singly charged positive ions). In this model, a range to approximately 2× velocity was correctable (4× thermal energy) but there is a limit when the width of a high dispersion beam at the lens exceeds the lens' spatial acceptance. Since the charge state of the ions maps directly with dispersion velocity, the variation in optimum lens voltage for different charge states can be approximately determined, and this variation of lens voltage (vertical axis) with ion charge state (horizontal axis) is shown in FIG. 8. In practice, calibration of the lens voltages on the spectrometer itself would be preferable to using simulation derived values.

The disclosure enables ion focusing to be controlled and optimised for the different charge states that may be present in the charge state distributions that the analyser may encounter. Some understanding of the sample's ion charge state distributions prior to ion analysis is required to optimise ion focusing settings. In some cases, this may be inferred or predicted from knowledge of the type of sample and/or application, or the mass spectrometer where it comprises a charge state filter, such as an ion mobility device upstream of the pulsed ion injector, so that only ions of known charge states are delivered to the ToF spectrometer, or a pre-scan performed to determine ion charge states before analysis in one or more analytical scans.

Figure 9A:
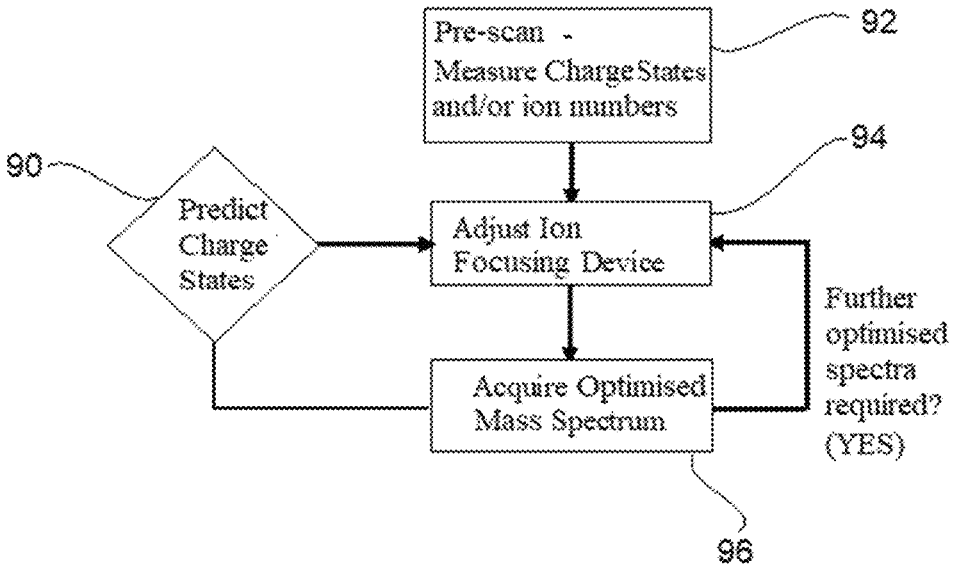
FIG. 9A shows a flow diagram schematically representing a method of mass spectrometry in which predicted or measured data on a charge state and/or number of ions of at least one ion species is used to adjust an ion focusing lens voltage.

A flow diagram of an embodiment of a method according to the disclosure is shown in FIG. 9A. In the embodiment of mass spectrometer shown in FIG. 1, the controller 34 uses data on a charge state and/or an amount of at least one species of ions in the ion beam to control the variable voltage supply 32 and select a voltage to be applied to the ion focusing lens 12. The charge state of the species of ions can be obtained in different ways. The charge state can be an approximate value of the charge state or an accurate value. The charge state of the ions can be predicted, e.g. from prior knowledge of the type of sample used to generate the ions. A user may therefore input information to the controller (i.e. to the controller computer via a user interface) on one or more charge states of ions to be generated from a particular sample, or on the type of sample (e.g. sample origin (e.g. blood), molecular species (e.g. a metabolite), molecular class (e.g. proteins) etc.) such that the controller predicts the expected charge state(s) from the type of sample. Predicted charge state data is thus obtained by the controller in a step 90 shown in FIG. 9A. Alternatively, the one or more charge states of the ions can be measured in a pre-scan, e.g. from analysis of one or more mass spectra acquired by the detector and data acquisition system 30. Routinely used algorithms, such as THRASH and Advanced Peak Detection, can be used by the data acquisition system 30 to determine charge states of ions from mass spectra that are generated from data acquired by the detector. Measured charge state data is thus obtained by the controller in a step 92. The measured charge state data may be obtained alternatively or additionally to predicted charge state data, e.g. to verify or modify predicted charge state data. The amount of ions of a species of ions can be obtained in different ways, e.g. by the data acquisition system 30 from the measured peak intensity of species of ions in one or more mass spectra acquired from the detector in a pre-scan. In some embodiments, therefore, a pre-scan (i.e. preliminary mass spectrum) is first acquired by the detector and data acquisition system to obtain data on the charge state and/or the amount of ions of at least one species of ions in the ion beam in a step 92.

The controller 34 is communicatively connected to the data acquisition system 30 so that the acquired data on charge states and/or ion abundance can be used by the controller to control the variable voltage supply 32 accordingly in step 94. Additionally, or alternatively, user input data on charge states and/or ion abundance can be used by the controller to control the variable voltage supply 32 in this step. The controller 34 uses control signals to control the variable voltage supply 32. The controller comprises a computer that is programmed with a program to control the variable voltage supply according to the data on at least one charge state and/or amount of at least one ion species in the ion beam. For example, in some embodiments, when the data on charge state indicates that there are only singly charged ions present and/or that a mass spectrum should be acquired using ion beam condition optimised for the singly charged ions, according to the program the controller 34 controls the variable voltage supply 32 to apply a first voltage ($V_1$) to the ion focusing lens 12. When the data on charge state indicates that there are multiply charged ions present, and/or that a mass spectrum should be acquired using ion beam conditions optimised for the multiply charged ions, the controller 34 controls the variable voltage supply 32 to change the voltage applied to the focusing lens 12 from the first voltage ($V_1$) to a second voltage ($V_2$) that is different to $V_1$.

In this way, a plurality of different voltages may be applied to the focusing lens from the variable voltage supply 32 depending on the charge state(s) of the ions in the ion beam. For example, a first voltage ($V_1$) may applied to the focusing lens 12 for singly charged ions, a second voltage ($V_2$) for multiply charged ions of charge +2 to +5, a third voltage ($V_3$) for multiply charged ions of charge +6 to +10, . . . and so on. In some embodiments, a different voltage could be applied for each different charge state, e.g. voltage $V_1$ for charge +1, voltage $V_2$ for charge +2, voltage $V_3$ for charge +3, . . . and so on. In some embodiments, a different voltage could be applied for different ranges of charge states, e.g. voltage $V_1$ for charge state +1, voltage $V_2$ for charges +2 to +4, voltage $V_3$ for charges +5 to +7, . . . and so on.

As well as effects caused by higher charge states, space charge effects may be caused within the spectrometer by intense ion peaks, or neighbouring intense ion peaks, and increase ion beam dispersion and may thus also be at least partially corrected by variation of the voltage(s) on the ion focusing lens(es), especially the drift focusing lens. As with the variation of voltage with charge state, it is necessary to have some foreknowledge of the intense ion peaks (packets) or clusters of peaks as they approach the relevant focusing lens so that the voltage may be adjusted. This may be done with a pre-scan, as described above, or in some embodiments using an inductive charge or current detection device having an electrode that is preferably positioned close to the ion beam upstream of the focusing lens, preferably near to the ion source at the ions' first time focus as this maximises the resolution and signal intensity from the detection device. In the spectrometer described in FIG. 1, this electrode would best be positioned between the ion injector 4 and the first out-of-plane lens 54, as the first time focus is located here and the time available for the detection and the voltage response is maximised. As an example, intense ion peaks or packets (e.g. about 100-1000s ions) would induce a detectable current on a charge detector, resulting in a signal that could trigger a change in lens voltage to correct for the space charge of the ion packet.

Accordingly, in some embodiments, when the data on the number of ions of an ion species indicates that the number is below a first threshold set by the computer program and/or a mass spectrum should be acquired using ion beam condition optimised for ions of that ion species, according to the program the controller 34 controls the variable voltage supply 32 to apply a first voltage ($V_1$) to the ion focusing lens 12. When the data on the number of ions of an ion species indicates that the number is above the first threshold and/or that a mass spectrum should be acquired using ion beam conditions optimised for ions of that ion species, the controller 34 controls the variable voltage supply 32 to change the voltage applied to the focusing lens 12 from the first voltage ($V_1$) to a second voltage ($V_2$) that is different to $V_1$. When the data on the number of ions of an ion species indicates that the number is above the first threshold and/or that a mass spectrum should be acquired using ion beam conditions optimised for ions of that ion species, the controller 34 controls the variable voltage supply 32 to change the voltage applied to the focusing lens 12 from the first voltage ($V_1$) to a second voltage ($V_2$) that is different to $V_1$. In some embodiments, a different voltage could be applied for different ranges of ion numbers, e.g. voltage $V_1$ for ion numbers in a range $I_1$ to $I_2$, voltage $V_2$ for ion numbers above $I_2$ to $I_3$, voltage $V_3$ for ion numbers above $I_3$ to $I_4$, . . . and so on.

The voltage applied to the ion focusing lens by the variable voltage supply 32 may be a function of both a charge state and an amount of ions of at least one ion species in the ion beam. Thus, the voltage V applied to the lens may be given by V=f(z,l), where f(z,l) is a function depending on terms z and l that represent a charge state (z) and an amount of ions (l) respectively.

The values of the voltages to be applied based on the charge state and/or the number of ions of at least one ion species in the ion beam may be determined by a calibration procedure. In one embodiment, one or more calibration mixtures may be ionised to provide one or more calibration mixtures of ions, which are mass analysed by the spectrometer. The calibration mixtures contain molecules that form ions typically of known m/z. An example of a calibration mixture is Pierce™ FlexMix™ Calibration Solution available from Thermo Fisher Scientific™, which is a mixture of 16 highly pure, ionisable components (mass ranges: 50 to 3000 m/z) designed for both positive and negative ionisation calibration, largely providing singly charged ions. Calibration solutions for providing multiply charged ions can contain a protein mixture for example; commonly used proteins in calibration solutions include ubiquitin, myoglobin, cytochrome C and/or carbonic anhydrase but many other proteins and/or peptides can be used in the calibration mixtures as required. For example, Pierce™ Retention Time Calibration Mixture contains a mixture of 15 known peptides. During the calibration procedure, mass analysing the one or more calibration mixtures of ions (recording mass spectra) is performed at varying voltages applied to the ion focusing arrangement 12 to determine the dependence of the recorded m/z values and peak intensities on the voltage variation for different ion masses (m), charge states (z) and peak intensities. The optimised voltage to be applied to the ion focusing arrangement 12 can thus be determined for given m, z and/or peak intensities (ion numbers). In some aspects of this disclosure, additional or alternative calibration procedures using one or more calibration mixtures may be carried out, wherein a dependence of the recorded m/z values and peak intensities is determined for pressure and/or voltage variations in the ion injector (ion trap) 4. Such dependencies of recorded m/z values and peak intensities (on the ion focusing arrangement voltage, injector pressure and/or injector voltage) may be approximated by functions (e.g. smooth functions, such as splines). The approximation functions may also be used for post-acquisition correction of acquired mass spectra, e.g. prior to saving the spectra. Preferably, determined multi-dimensional dependencies may be approximated by such functions (e.g. splines) and used for online correction of acquired mass spectra prior to saving them.

Using an adjusted, optimised voltage on the ion focusing lens, a mass spectrum can be acquired under optimum ion beam conditions for the particular charge state and/or number of ions of the at least one species used to set the voltage, as shown by step 96 in FIG. 9A. After acquiring the desired number of mass spectra using the optimised voltage, if it is required to acquire further mass spectra optimised instead for a further charge state and/or number of ions of at least one species in the ion beam, the controller can return to step 94 to adjust the voltage applied to the ion focusing lens to a different value to optimise ion beam conditions for the particular further charge state and/or number of ions, and a further mass spectrum or spectra can be acquired, and so on. The method ends when no further spectra are required.

In a further embodiment, a mass spectrometer as generally shown in FIG. 1 further comprises an ion fragmentation device, such as collision induced dissociation (CID) cell or other dissociation cell, located upstream of the ion injector 4 to enable performing MS2 analysis of ions. A mass filter, such as a quadrupole mass filter, is also located upstream of the ion fragmentation device for selection of ions of particular m/z to be fragmented. In MS2, the controller 34 can be configured to control the voltage supply to vary the voltage supplied to the ion focusing arrangement based on data on a charge state and/or an amount of at least one species of product ions derived from MS1 analysis of ions performed prior to the MS2 analysis. In this way, adjustment of the focusing and ion beam dispersion in an MS2 (product ion) scan may be based on charge state and/or abundance data acquired from a prior MS1 (precursor ion) scan. The controller computer may be configured to predict at least one charge state of product ions in an MS2 analysis from at least one charge state of parent ions acquired in an MS1 analysis, for example, using fragmentation knowledge or rules about the fragmentation behaviour of parent ions.

Figure 9B:
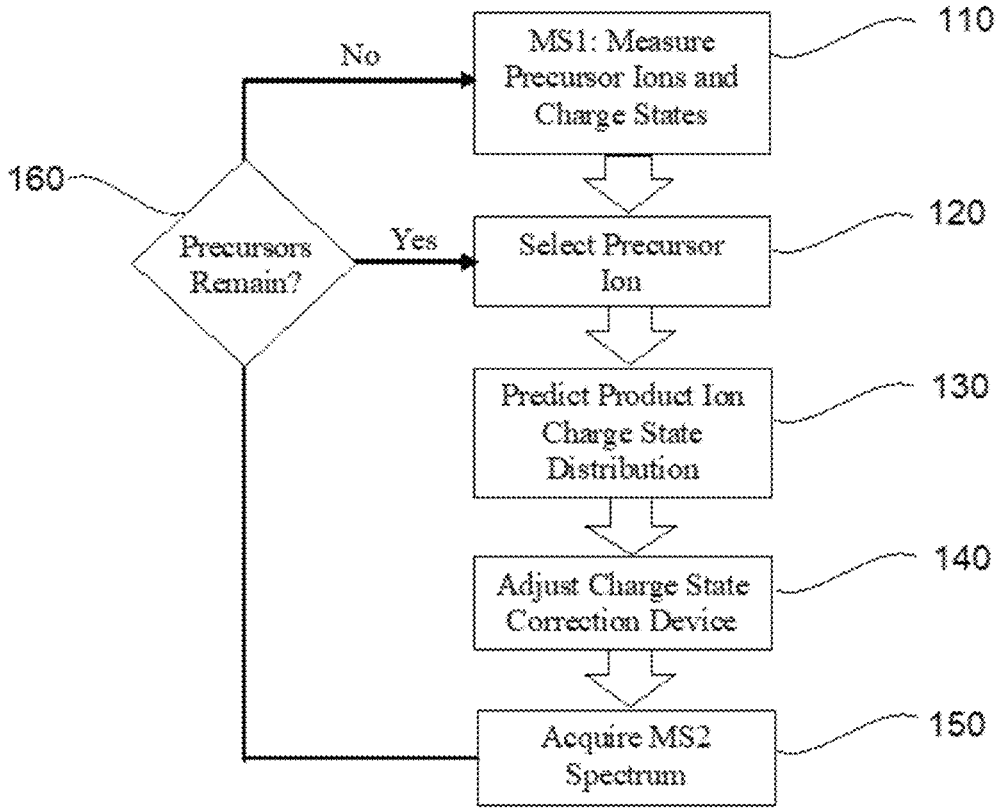
FIG. 9B shows a flow diagram schematically representing a method of tandem (MS2) mass spectrometry, in which charge states of product ions are predicted from charge states of parent ions from MS1 scans and lens voltages are adjusted in MS2 for product ion charge states.

Thus, in a particular embodiment, this disclosure provides a method for tandem (MS2) mass spectrometry, in which the charge states of the parent ions are determined during MS1 scans, as is routinely performed by algorithms such as THRASH and Advanced Peak Detection. For the MS2 scans, the charge state of the product ions will be dependent on the charge state of the parent ions, as well as other factors such as dissociation method and conditions (normalised collision energy, choice of gas etc). The broad relationship can be used to help infer likely product ion charge states, and set the focusing lens voltage accordingly to make a correction for charge state. A simple flow diagram of such a method is shown in FIG. 9B. In a step 110, an MS1 scan of precursor ions is performed. The MS1 scan is analysed using a charge state detection algorithm to ascertain the distribution of charge states present among the precursor ions. In step 120, the mass spectrometer then selects, using the mass filter, a particular precursor ion species for MS2 analysis. From the determined charge state of the precursor ion, in step 130 the computer of the controller predicts the charge state(s), i.e. the charge state distribution, of the product ions and in step 140 the controller adjusts the voltage applied by the variable voltage supply to the ion focusing arrangement (charge state correction device) to a value that is an optimum determined for the charge state distribution of the product ions. In step 150, the MS2 scan is acquired by the spectrometer using the voltage setting for the ion focusing arrangement set in preceding step 140. A decision is then made by the computer of the controller in step 160 such that if further precursors remain to be analysed by MS2 analysis, another precursor is selected and the method proceeds again from step 120, and if no further precursors remain to be analysed by MS2 the method terminates or returns to step 110 ready to acquire a new MS1 spectrum.

Figure 10:
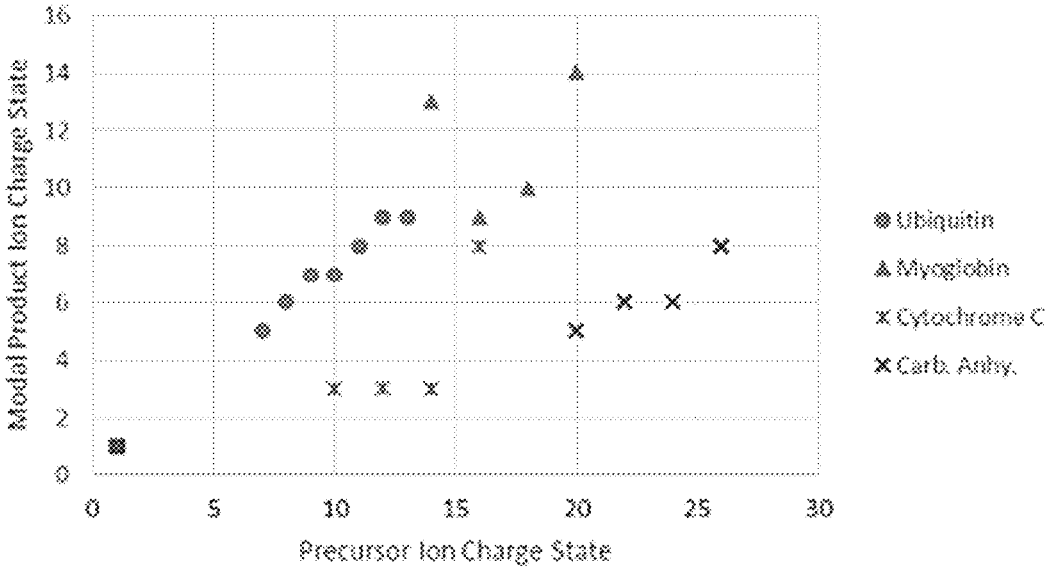
FIG. 10 shows relationships between product ion modal charge states and precursor ion charge states for a number of different proteins.

Predicting the charge state relationship between precursor and product (fragment) ions is not always easy. It is obvious that only highly charged precursors can produce highly charged fragment ions, and intuitive that the greater the precursor charge the more the fragment ion charge state distribution will shift upwards. Madsen et al (*Anal. Chem.*, 2009, 81 (21), pp 8677-8686) have shown that as precursor charge state increases, the product ions both increase in modal charge state and broaden in charge state distribution. However, the trend is observed to vary with different protein ions, as shown in FIG. 10 for ubiquitin, myoglobin, cytochrome C and carb. anhy (carbonic anhydrase). Nevertheless, it can be beneficial to simply tune the ion focusing arrangement according to a simple function of the precursor ion charge state. For example, a linear trend 0.45× would fit based on the data in FIG. 10. However, it would be ideal to optimise a function for particular samples and conditions.

The variable voltage supply, in conjunction with the controller, may be configured to vary the voltage supplied to the ion focusing arrangement from one m/z scan to a subsequent m/z scan (i.e. between a scan of one pulse of ions and a subsequent scan of another pulse of ions). In this way, an earlier scan may be used to derive charge state and/or abundance data of at least one species of ions that is used to control the voltage applied to the ion focusing arrangement in a later scan. The earlier scan may be the immediately preceding scan to the later scan, or may be two, three, or more scans earlier. In one method, the voltage supply is configured to vary the voltage supplied to the ion focusing arrangement based on charge state data and/or space charge data (data on numbers of ions of different species) of ions in the ion beam acquired from a pre-scan of a pulse of ions from the ion injector.

The variable voltage supply, in conjunction with the controller, may be configured to vary the voltage supplied to the ion focusing arrangement based on data on a charge state and/or an amount of at least one species of ions in the ion beam that is acquired by the detector and/or, in some embodiments, using a charge measurement device for measuring charge in the ion beam. The charge measurement device can be located upstream of the ion focusing arrangement and may be located in or adjacent the ion path. The charge measurement device may comprise, for example, a grid located in the ion path or an image current measuring device located adjacent the ion path. Thus, it is possible for the voltage supply to be configured to vary the voltage supplied to the ion focusing arrangement within an m/z scan of a single pulse of ions from the ion injector. In other words, the voltage supply may be configured to vary the voltage supplied to the ion focusing arrangement based on data on a charge state and/or an amount of at least one species of ions in the ion beam acquired from the ions on the fly during an m/z scan of a pulse of ions from the ion injector. The data is acquired for a given species of ions in the ion beam by the upstream charge measurement and provided to the controller to adjust the voltage applied by the variable voltage supply to the ion focusing arrangement by the time the ions of the given ion species reach the ion focusing arrangement. Thus, the at least one variable voltage can be variable in a time dependent manner correlated to the arrival times at the ion focusing arrangement of ions of different charge state and/or different space charge, i.e. varied synchronously with the arrival of different ion species at the ion focusing arrangement.

The voltage applied to the ion focusing arrangement for at least one species that has a multiply charged state may be such as to normalize a spatial dispersion of the ions of the multiply charged state to a spatial dispersion of singly charged ions. In other words, the voltage supplied to the ion focusing arrangement may be adjusted such as to make the spatial dispersion of the multiple charged ion species substantially the same as the average spatial dispersion for singly charged ions.

The variable voltage supply, in conjunction with the controller, may be configured to apply the voltage to the ion focusing arrangement based on a charge state of a single ion species in the ion beam. In some other embodiments, the variable voltage supply, in conjunction with the controller, may be configured to apply the voltage based on a plurality of charge states of different ion species in the ion beam, for example based on a representative charge state value of a plurality of different ion species of different charge states. For example, the representative charge state may be an average charge state of a plurality of different ion species having different charge states. In this way, the voltage applied may be a compromise between optimum voltages for a number of different ion species having different charge states. Similarly, in certain embodiments, wherein the variable voltage supply, in conjunction with the controller, is configured to apply the voltage to the ion focusing arrangement based on at least one amount of ions, the at least one amount of ions may be an amount of ions of a single ion species. In certain other embodiments, the at least amount of ions may be a plurality of amount of ions of different ion species. The at least one amount of ions may comprise a representative amount of ions of a plurality of different ion species. For example, the representative amount of ions may be an average amount of ions of a plurality of different ion species having different amounts of ions present in the ion beam (different abundances). In this way, the voltage applied may be a compromise between optimum voltages for a number of different ion species having different abundances.

Figure 11:
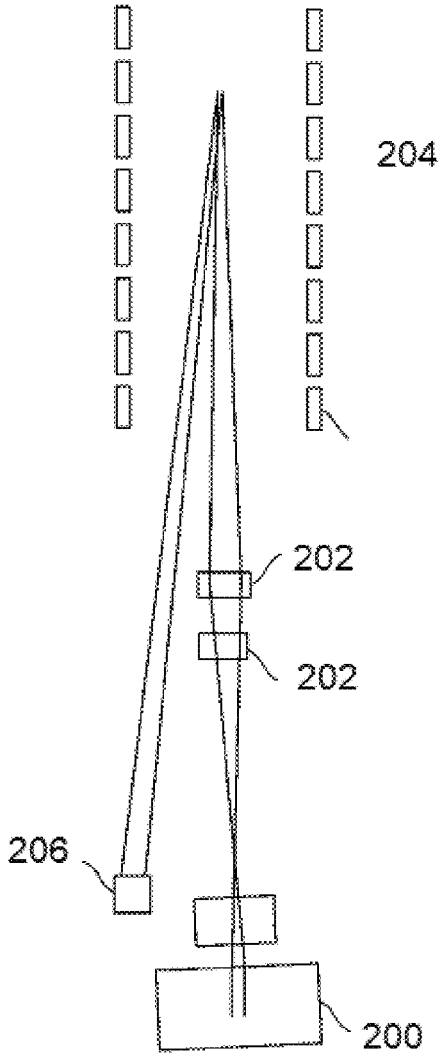
FIG. 11 shows schematically a single-reflection time-of-flight mass spectrometer having intermediate ion focusing lenses.

It should be understood that the mass spectrometer design shown in FIG. 1 is just one example of a time-of-flight mass spectrometer with which the teaching of the present disclosure may be used. Generally, the present disclosure has wider application to other types, including more common or simpler types of time-of-flight instrument, as long as they comprise at least one ion focusing lens. For example, the disclosure is applicable to a single-reflection time-of-flight mass spectrometer as shown schematically in FIG. 11 and disclosed in U.S. Pat. No. 9,136,100. A pulsed ion source 200 generates ions and the ion beam passes through two intermediate lenses 202 (in addition to lenses close to the source) located between the ion source 200 and ion mirror 204 for controlling ion beam dispersion in the y and z directions orthogonal to the ion beam path. After reflection in the ion mirror, the ions are detected by ion detector 206. The lenses 202 could have their voltages supplied by a variable voltage supply so that they can be adjusted as described herein for optimisation of ion beam properties based on charge state and/or number of ions of at least one ion species, or indeed generally based on space charge, temperature, m/z etc. The trans-axial type of focusing lens described herein is particularly suitable for use in the converging mirror mass spectrometer shown in FIG. 1. For a common, single-turn time-of-flight mass spectrometer, a single lens (such as an Einzel lens) as described in U.S. Pat. No. 9,136,100 could be used to provide adjustment of the beam dispersion dependent on a charge state and/or number of ions of an ion species.

In certain mass spectrometers, overall beam divergence may be, at least partly, determined by the initial spatial distribution of the ions in the ion injector, which is also normally a function of charge state and could be controlled by, for example, altering the trap conditions, such as adjusting the trapping voltages to change the axial potential well, depending on one or more charge states of the ions present. For example, the one or more trapping voltages could be changed in a manner dependent on differing charge states. Thus, a variation of the above described application is based on recognising that space charge effects within an RF ion trap used as ion injector may also be a factor that may need control of a focusing voltage for achieving optimal beam properties, as the size and effective temperature of the initial ion cloud in the ion trap varies. For time-of-flight mass analysers, however, it is generally preferred that this is not a factor as allowing ion cloud expansion impacts resolution by increasing the turnaround time in the ion trap. The initial axial distribution of ions in a linear trap is dependent on the axial DC potential well. For the linear ion trap shown in FIG. 2, this is controlled by the DC voltage applied to the end apertures. Since multiply charged ions are more strongly affected by DC potential wells than singly charged ions, they become more compressed and thus suffer even more space charge effects in the ion trap. Accordingly, in another aspect of the disclosure, the ion injector for forming the ion beam is an RF ion trap having a DC potential well to trap ions that is provided by one or more electrodes, and a variable voltage supply may provide at least one voltage to the one or more electrodes that is dependent on a charge state of at least one species of ions in the ion trap, thereby to adjust the DC potential well based on the anticipated ion charge state.

A further variation of the above described application of the ion focusing lens is to control the voltage applied to the lens to compensate for variations in ion energy caused by higher mass ions being improperly cooled in the ion trap injector 4, compared to lower mass ions. Generally, ions are thermalized in an ion trap used as an ion injector by collisional cooling in the ion trap before extraction into the mass analyser. However, efficient cooling of higher m/z ions requires high background gas pressure, which can both create excessive pressure in the analyser itself, impeding ion transmission, or cause fragmentation of analyte ions by high energy collisions as they are extracted from the trap. Higher m/z ions may have a further difficulty in that their larger size increases the probability of unwanted collisions in flight. The long cooling times ideally required to thermalize such ions at low pressure are simply not practically available in instruments that operate at scan frequencies >100 Hz. If there is insufficient time or pressure to thermalize ions across the desired mass range then there will be a variation in ion dispersion across that mass range. By being able to vary a focusing lens voltage, however, to compensate for the variation in dispersion is useful to maintain performance across the desired mass range. A control of the focusing lens voltage with ion mass may also allow for shorter cooling times to be used and thus faster instrument operation. The voltage applied by the variable voltage supply to the ion focusing arrangement could thus be varied in a time dependent manner that correlates with the arrival time of ions of varying m/z. Such adjustment of the focusing lens voltage can be applied on top of, i.e. in addition to, the proposed adjustment of the focusing voltage for the charge state distribution and/or number of ions of at least one ion species in the beam. Thus, the adjustment of the focusing voltage may be a function of charge state and/or number of ions of at least one ion species and the ion mass (arrival time at the ion focusing arrangement).

Figure 12:
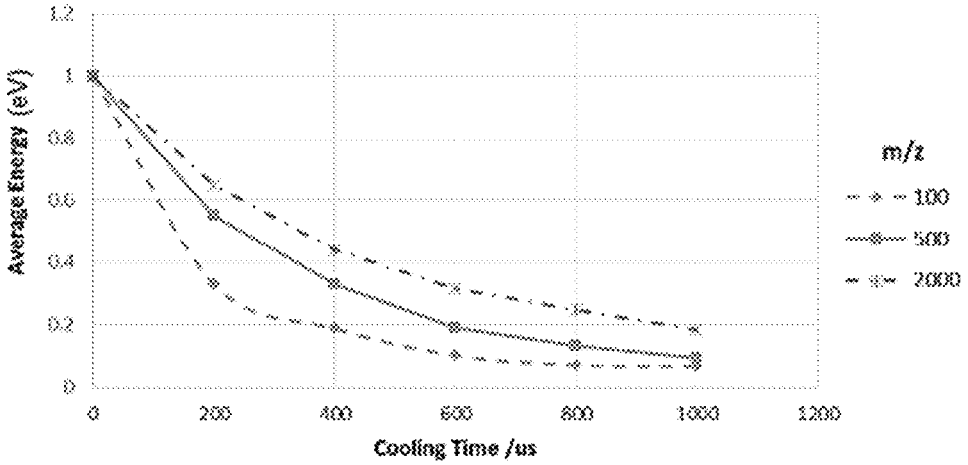
FIG. 12 shows simulated collisional cooling of ions of differing m/z with time in $1\times10^{-3}$ mbar $N_2$ buffer gas.
Figure 13:
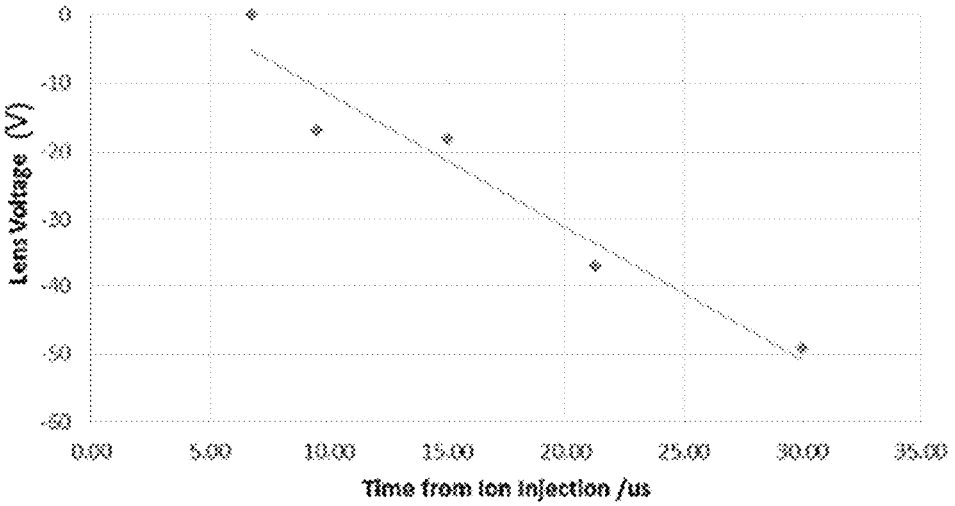
FIG. 13 shows an optimum focusing lens voltage variation with time from ion injection.

In a simulated example, an ion trap was arranged with $1\times10^{-3}$ mbar of nitrogen buffer gas, and ions were injected into it with 1 eV of energy. The energies over 1 ms of cooling time are shown in FIG. 12. If ions were subsequently extracted from the trap after 1 ms of cooling, the m/z 100-2000 mass range would reach the drift controlling lens over 7-30 μs. Applying the simulated drift lens optima vs energy with the ion arrival times gives the time-dependent voltage shown in FIG. 13. It is reasonable for practical cases to use an approximate voltage with a linear trend, as the most efficient way to generate such a fast voltage change is to switch between 2 voltages levels (0 to −50V in this case) with a transistor based switch and a suitable resistance and capacitance to control the rise time to about 25 μs. Alternatively, a function generator may be used to give a better calibrated fit. The timing and gradient of this dynamic voltage may also be altered to suit the expected ion charge state distribution.

Figure 14:
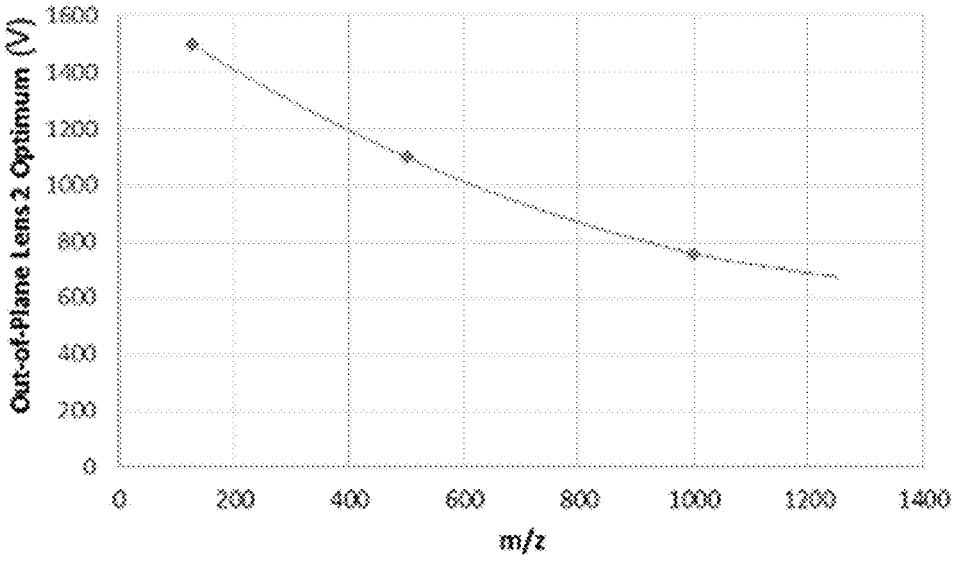
FIG. 14 shows a simulated m/z dependency for optimum voltages of an out-of-plane lens.
Figure 15:
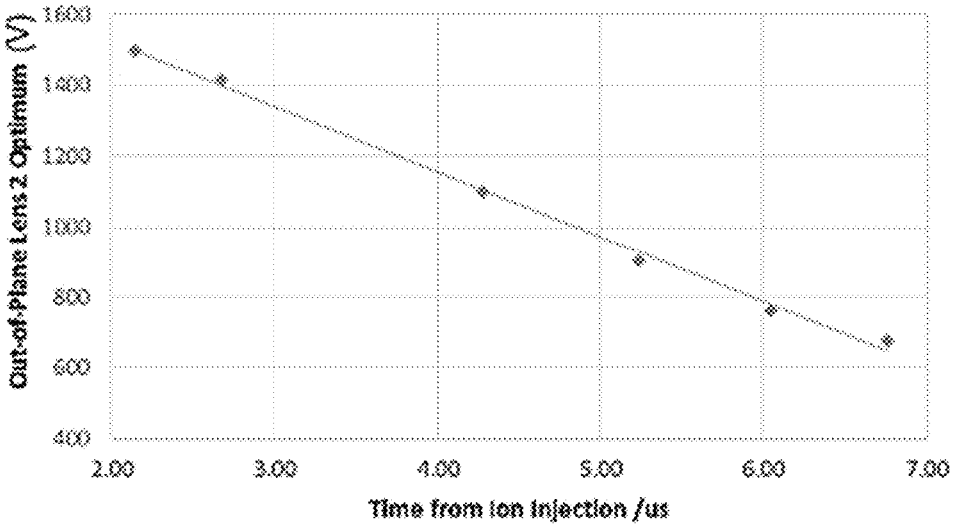
FIG. 15 shows a voltage applied to an out-of-plane lens as a function of time from ion injection.

Within RF ion traps, ions at the low m/z end of the stable m/z range occupy a smaller volume than high m/z ions. Consequently, the optimum voltage applied to focusing lenses of the mass spectrometer will ideally have some m/z dependency related to that initial spatial distribution as described. In the ToF mass spectrometer shown in FIG. 1, the ion injector 4 is a linear RF ion trap with the ions trapped along the elongate axis by a DC potential well, which is aligned with the drift direction Y in the spectrometer. This means that there should be little m/z related initial spatial differences along this drift direction (beyond small ones related to charge state distributions with m/z), and there would be little benefit to applying a correction voltage to the drift controlling electrode for that reason. The out-of-plane lenses 54, 58, however, have a considerable m/z dependency in their optimum voltages from the ion trap source, and simulation results show this in FIG. 14. The voltage function to apply to the second out-of-plane lens 58 based on this is shown in FIG. 15. Again, this is preferably kept roughly linear for reasons of practical electronic design, where a voltage is switched between two levels with a suitable time constant.

The terms mass and m/z are used herein interchangeably and accordingly a reference to one includes a reference to the other.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc., mean "including but not limited to" and are not intended to (and do not) exclude other components.

It will be appreciated that variations to the foregoing embodiments of the invention can be made while still falling within the scope of the invention as defined by the claims. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

What is claimed is:

1. A time-of-flight mass spectrometer, comprising:

a pulsed ion injector for forming an ion beam that travels along an ion path;

a detector for detecting ions in the ion beam that arrive at the detector at times according to their m/z values;

an ion focusing arrangement located between the ion injector and the detector for focusing the ion beam in at least one direction orthogonal to the ion path; and a variable voltage supply for supplying the ion focusing arrangement with at least one variable voltage that is dependent on a charge state and/or an amount of ions of at least one species of ions in the ion beam.

2. A time-of-flight mass spectrometer according to claim 1, wherein the voltage supply is configured to vary the voltage supplied to the ion focusing arrangement based on data on a charge state and/or an amount of at least one species of ions in the ion beam acquired by the detector and/or a charge measurement device for measuring charge in the ion beam.

3. A time-of-flight mass spectrometer according to claim 1, further comprising a controller configured to use data on a charge state and/or an amount of ions of at least one species in the ion beam to control the voltage supply.

4. A time-of-flight mass spectrometer according to claim 3, wherein the controller is configured to predict at least one charge state of product ions in an MS2 analysis from at least one charge state of parent ions acquired in an MS1 analysis.

5. A time-of-flight mass spectrometer according to claim 1, wherein the variable voltage supply is configured to vary the variable voltage supplied to the ion focusing arrangement from one m/z scan of an ion pulse from the ion injector to a subsequent scan of another ion pulse from the ion injector.

6. A time-of-flight mass spectrometer according to claim 1, wherein the variable voltage supply is configured to vary the variable voltage supplied to the ion focusing arrangement based on charge state data and/or data of amount of ions in the ion beam acquired from a pre-scan of a pulse of ions from the ion injector.

7. A time-of-flight mass spectrometer according to claim 1, wherein the variable voltage supply is configured to vary the variable voltage supplied to the ion focusing arrangement within an m/z scan of a pulse of ions from the ion injector.

8. A time-of-flight mass spectrometer according to 7, wherein the variable voltage supply is configured to vary the voltage supplied to the ion focusing arrangement based on data on a charge state and/or an amount of at least one species of ions in the ion beam acquired from the ions on the fly during an m/z scan of a pulse of ions from the ion injector.

9. A time-of-flight mass spectrometer according to claim 7, wherein the at least one variable voltage is variable in a time dependent manner correlated to arrival times at the focusing arrangement of ions of different charge state and/or different space charge.

10. A time-of-flight mass spectrometer according to claim 1, wherein the charge state of the ions comprises a multiply charged state, and the variable voltage supply is configured to vary the variable voltage supplied to the ion focusing arrangement to normalize a spatial dispersion of the ions of the multiply charged state to a spatial dispersion of singly charged ions.

11. A time-of-flight mass spectrometer according to claim 1, wherein the at least one charge state is a charge state of a single ion species.

12. A time-of-flight mass spectrometer according to claim 1, wherein the at least one charge state is a plurality of charge states of different ion species.

13. A time-of-flight mass spectrometer according to claim 1, wherein the at least one charge state is a representative charge state of a plurality of different ion species.

14. A time-of-flight mass spectrometer according to claim 13, wherein the representative charge state is an average charge state of the plurality of different ion species.

15. A time-of-flight mass spectrometer according to claim 1, further comprising at least one ion mirror configured to reflect the ion beam along the ion path.

16. A time-of-flight mass spectrometer according to claim 15, further comprising a plurality of ion mirrors configured to reflect the ion beam a plurality of times along the ion path.

17. A time-of-flight mass spectrometer according to claim 16, further comprising two ion mirrors spaced apart and opposing each other in a direction X, each mirror elongated generally along a drift direction Y, the drift direction Y being orthogonal to the direction X, configured to provide a zigzag ion path by reflecting the ion beam multiple times between the ion mirrors in the direction X whilst the ion beam drifts in the drift direction Y.

18. A time-of-flight mass spectrometer according to claim 1, wherein the ion path lies in a plane and the ion focusing arrangement is for focusing the ion beam in a direction within the plane.

19. A time-of-flight mass spectrometer according to claim 1, wherein the ion path lies in a plane and the ion focusing arrangement is for focusing the ion beam in a direction out of the plane.

20. A time-of-flight mass spectrometer according to claim 1, wherein the ion focusing arrangement comprises at least one ion focusing lens and the voltage supply is for supplying at least one variable voltage to the at least one ion focusing lens, wherein the at least one ion focusing lens is selected from the following: a trans-axial lens, an Einzel lens, and a multipole lens.

21. A time-of-flight mass spectrometer according to claim 20, comprising at least one ion mirror along the ion path configured to reflect the ion beam, wherein the at the at least one ion focusing lens is located before a first reflection in the at least one ion mirror.

22. A time-of-flight mass spectrometer according to claim 21, comprising a plurality of ion mirrors configured to reflect the ion beam a plurality of times, wherein at least one ion focusing lens of the ion focusing arrangement is located after a first reflection and before a fifth reflection in the ion mirrors.

23. A time-of-flight mass spectrometer according to claim 1, further comprising an ion fragmentation device upstream of the ion injector for performing MS2 analysis of ions, wherein the voltage supply is configured to vary the voltage supplied to the ion focusing arrangement in MS2 analysis based on data on a charge state and/or an amount of at least one species of product ions derived from MS1 analysis of ions performed prior to the MS2 analysis.

24. A method of mass spectrometry, comprising:

forming an ion beam from a pulsed ion injector that travels along an ion path;

detecting ions in the ion beam that arrive at a detector at times according to their m/z values;

focusing the ion beam in at least one direction orthogonal to the ion path using an ion focusing arrangement located between the ion injector and the detector; and supplying the ion focusing arrangement with at least one variable voltage from a variable voltage supply, wherein the variable voltage is dependent on a charge state and/or an amount of ions of at least one species of ions in the ion beam.

25. A method of mass spectrometry according to claim 24, wherein the dependence of the at least one variable voltage on the charge state and/or the amount of ions of at least one species of ions in the ion beam has been determined from a calibration, wherein the calibration comprises detecting one or more calibration mixtures of ions with varying voltages supplied to the ion focusing arrangement to determine a dependence of detected m/z values and/or peak intensities on the variable voltage for different charge states and/or amounts of ions.

* * * * *